US008310174B2

(12) United States Patent
Ikeda

(10) Patent No.: US 8,310,174 B2
(45) Date of Patent: Nov. 13, 2012

(54) LIGHTING METHOD AND LIGHTING APPARATUS FOR A HIGH PRESSURE DISCHARGE LAMP, A HIGH PRESSURE DISCHARGE LAMP APPARATUS, AND A PROJECTION-TYPE IMAGE DISPLAY APPARATUS

(75) Inventor: Masaru Ikeda, Osaka (JP)

(73) Assignee: Panasonic Corporation, Osaka (JP)

( * ) Notice: Subject to any disclaimer, the term of this patent is extended or adjusted under 35 U.S.C. 154(b) by 472 days.

(21) Appl. No.: 12/667,223

(22) PCT Filed: Aug. 29, 2008

(86) PCT No.: PCT/JP2008/002382

§ 371 (c)(1),
(2), (4) Date: Dec. 29, 2009

(87) PCT Pub. No.: WO2009/028213

PCT Pub. Date: Mar. 5, 2009

(65) Prior Publication Data

US 2010/0177286 A1 Jul. 15, 2010

(30) Foreign Application Priority Data

Aug. 31, 2007 (JP) ..... 2007-226319

(51) Int. Cl.
*H05B 41/36* (2006.01)

(52) U.S. Cl. ..... 315/291; 315/309

(58) Field of Classification Search ..... 315/291, 315/307–309

See application file for complete search history.

(56) References Cited

U.S. PATENT DOCUMENTS

| | | | | |
|---|---|---|---|---|
| 5,463,287 | A * | 10/1995 | Kurihara et al. | 315/307 |
| 2002/0047610 | A1* | 4/2002 | Arimoto et al. | 315/246 |
| 2003/0201735 | A1* | 10/2003 | Yamamoto et al. | 315/291 |
| 2004/0000880 | A1 | 1/2004 | Ozasa et al. | |
| 2005/0007023 | A1* | 1/2005 | Arimoto et al. | 313/642 |
| 2009/0001904 | A1* | 1/2009 | Okawa | 315/291 |

FOREIGN PATENT DOCUMENTS

| | | |
|---|---|---|
| CN | 1459998 | 12/2003 |
| CN | 1937876 | 3/2007 |
| JP | 2007-087901 | 4/2007 |

OTHER PUBLICATIONS

Chinese Application No. 200880104799.1 Office Action dated Jun. 21, 2011, 18 pagse with English translation.

* cited by examiner

*Primary Examiner* — Don Le

(57) ABSTRACT

After discharge has begun in a high pressure discharge lamp, constant current control is performed so a lamp current becomes 4 [A]. Then, the current supplied to a pair of electrodes in the lamp is controlled so an electrode tip temperature t [degrees C.] at this time and an electrode tip temperature T [degrees C.] during stable lighting satisfy the relationship t [degrees C.]<=1.1 T [degrees C.]. When a power of the lamp reaches a rated power value, power control is changed to constant power control. This method enables suppressing an excessive rise in the temperature of the electrode tips in an initial lighting interval from lighting commencement until stable lighting, thereby preventing an increase in arc length due to melting of the electrode tips. Accordingly, illuminance does not readily decrease, particularly in a lamp unit including a high pressure discharge lamp mounted to a reflecting mirror.

12 Claims, 19 Drawing Sheets

[Fig. 1]
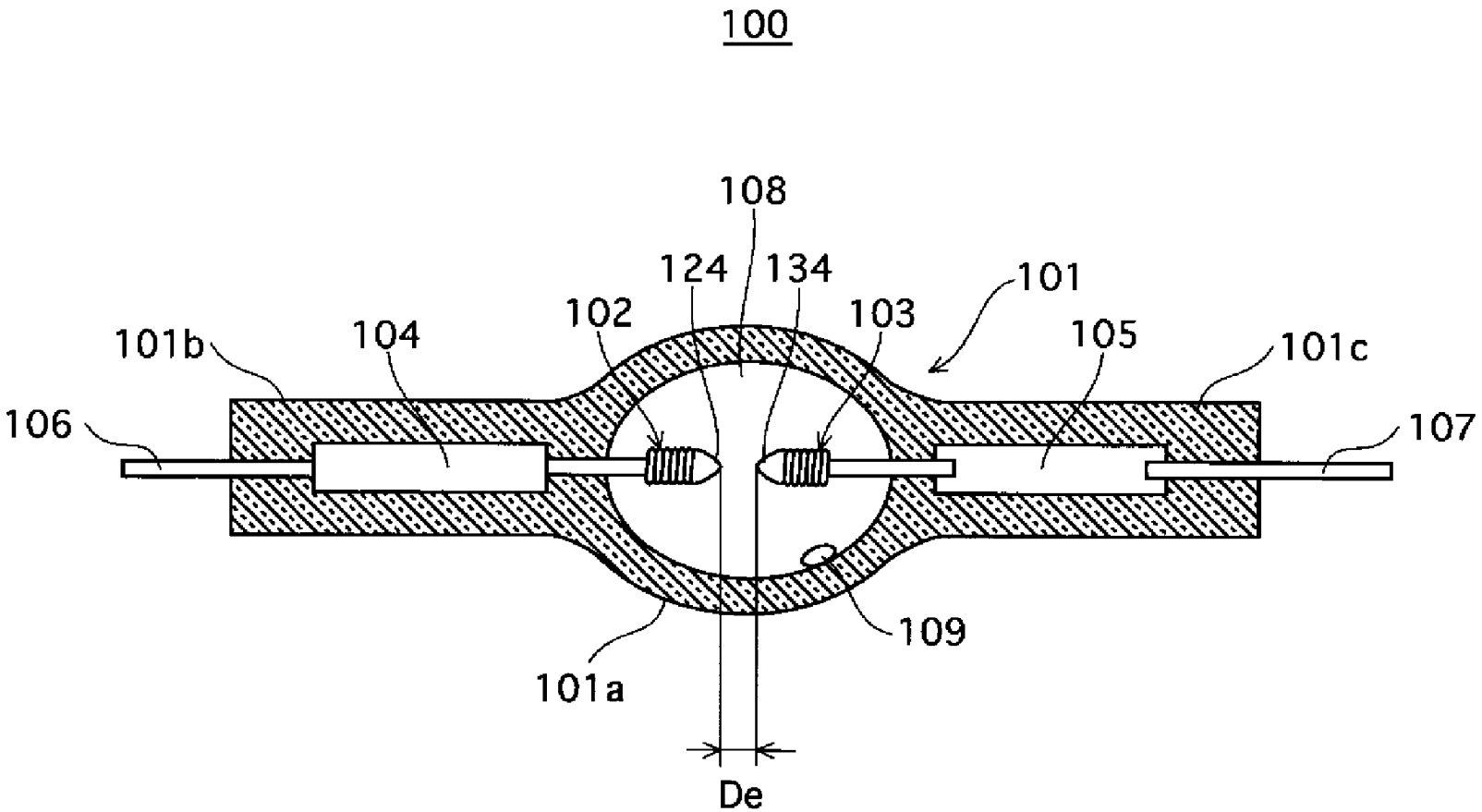

[Fig. 2]
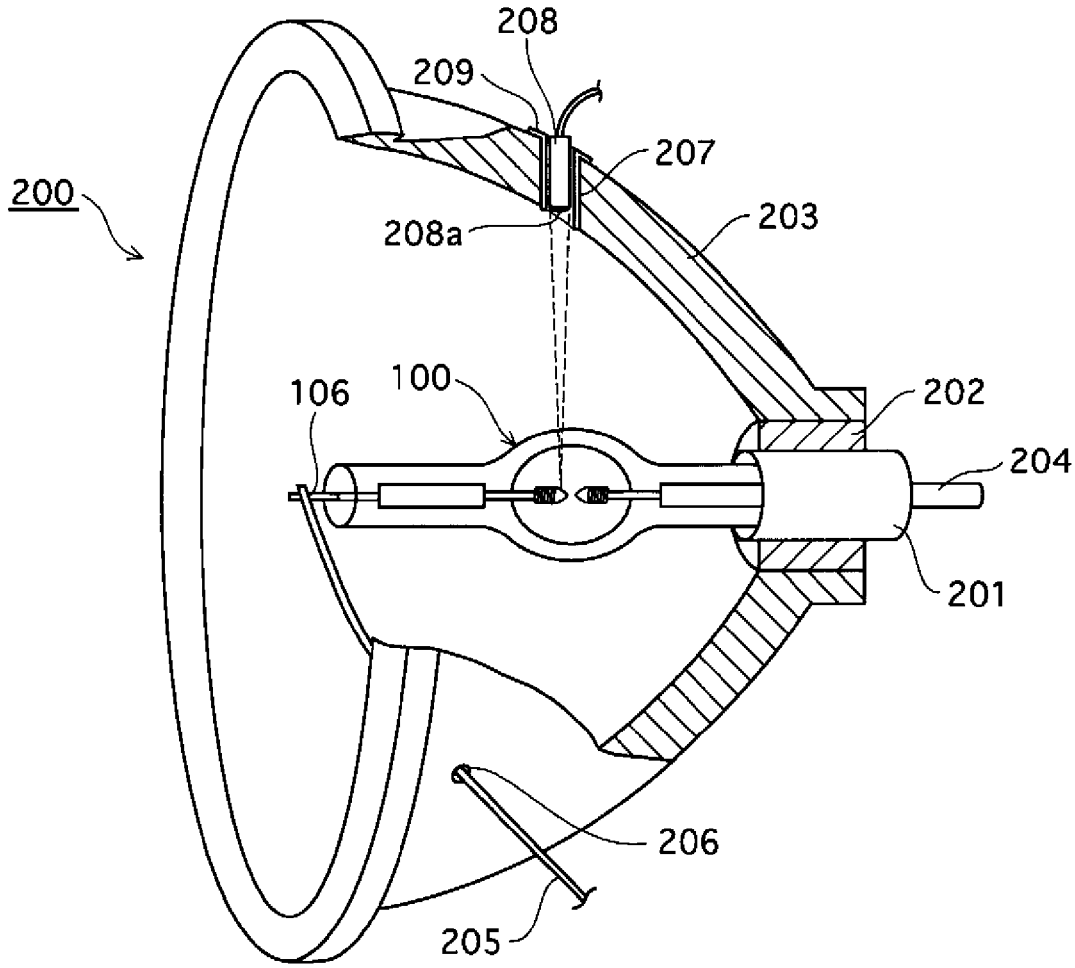

[Fig. 3]
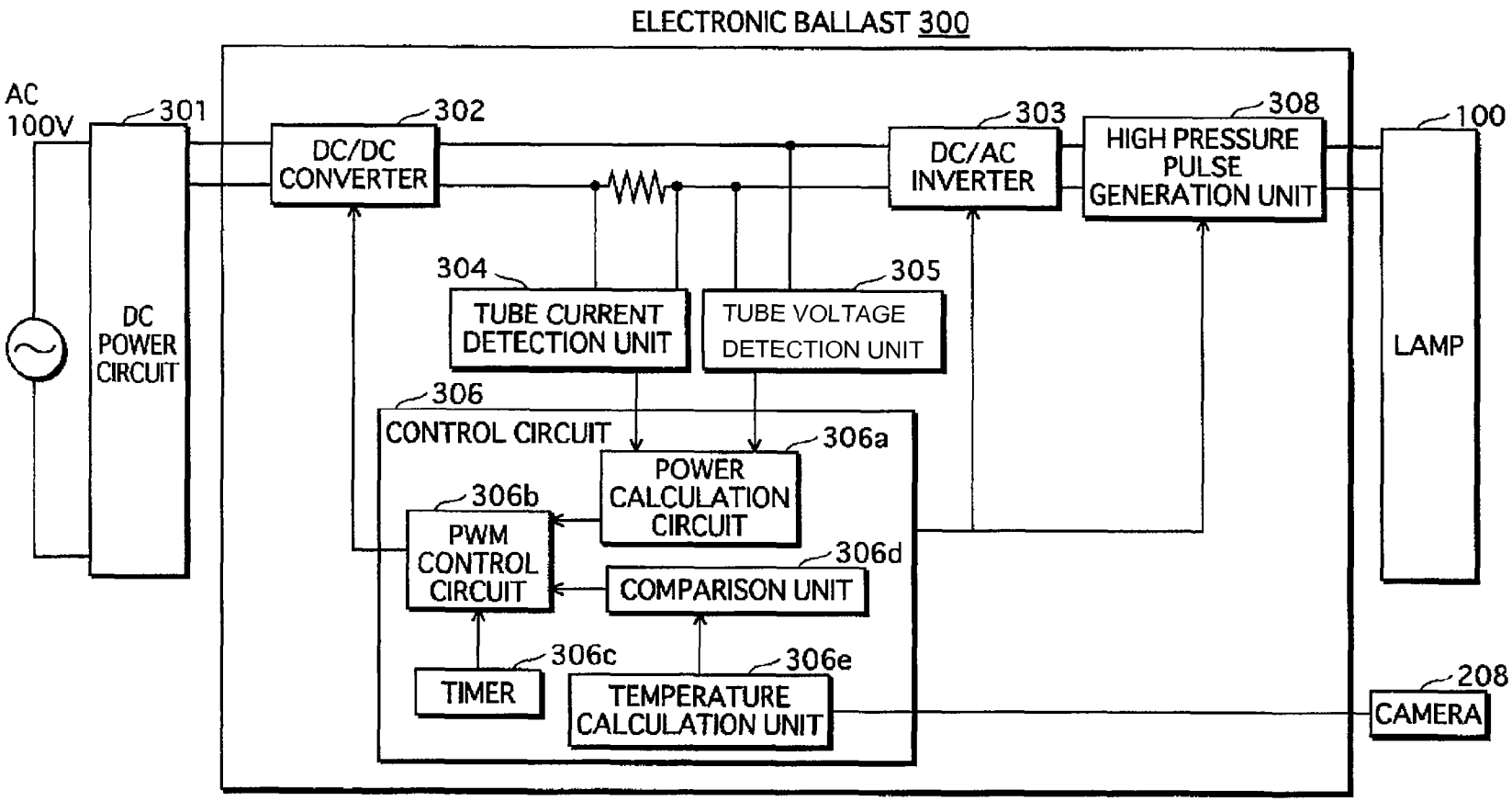

[Fig. 4]
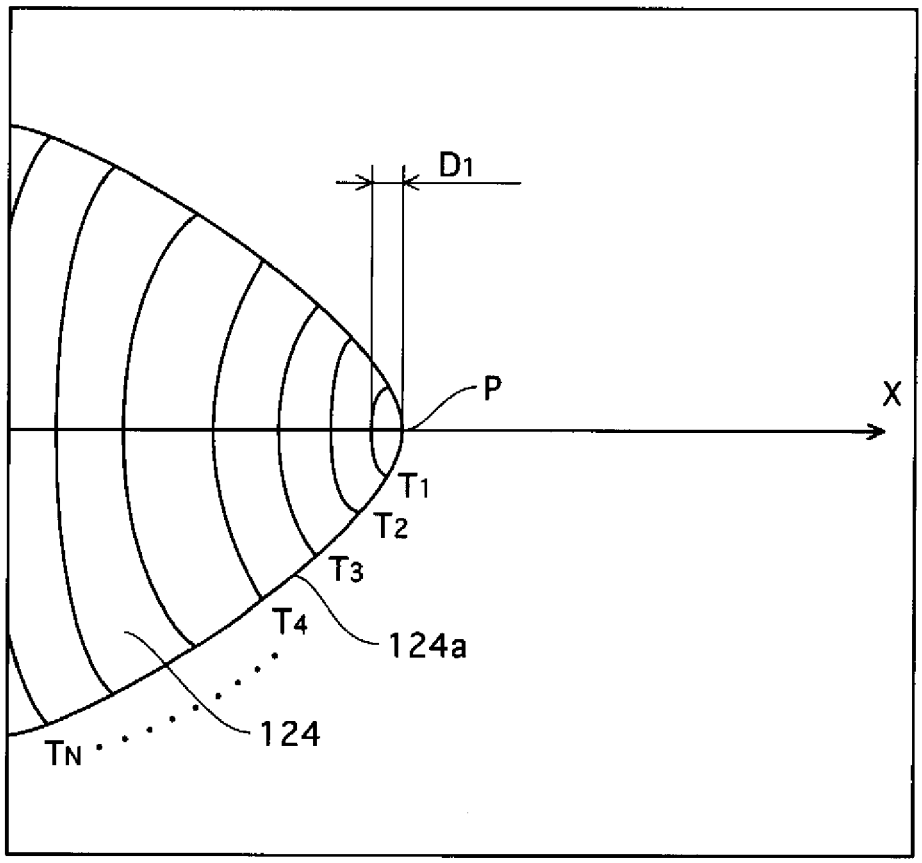

[Fig. 5]
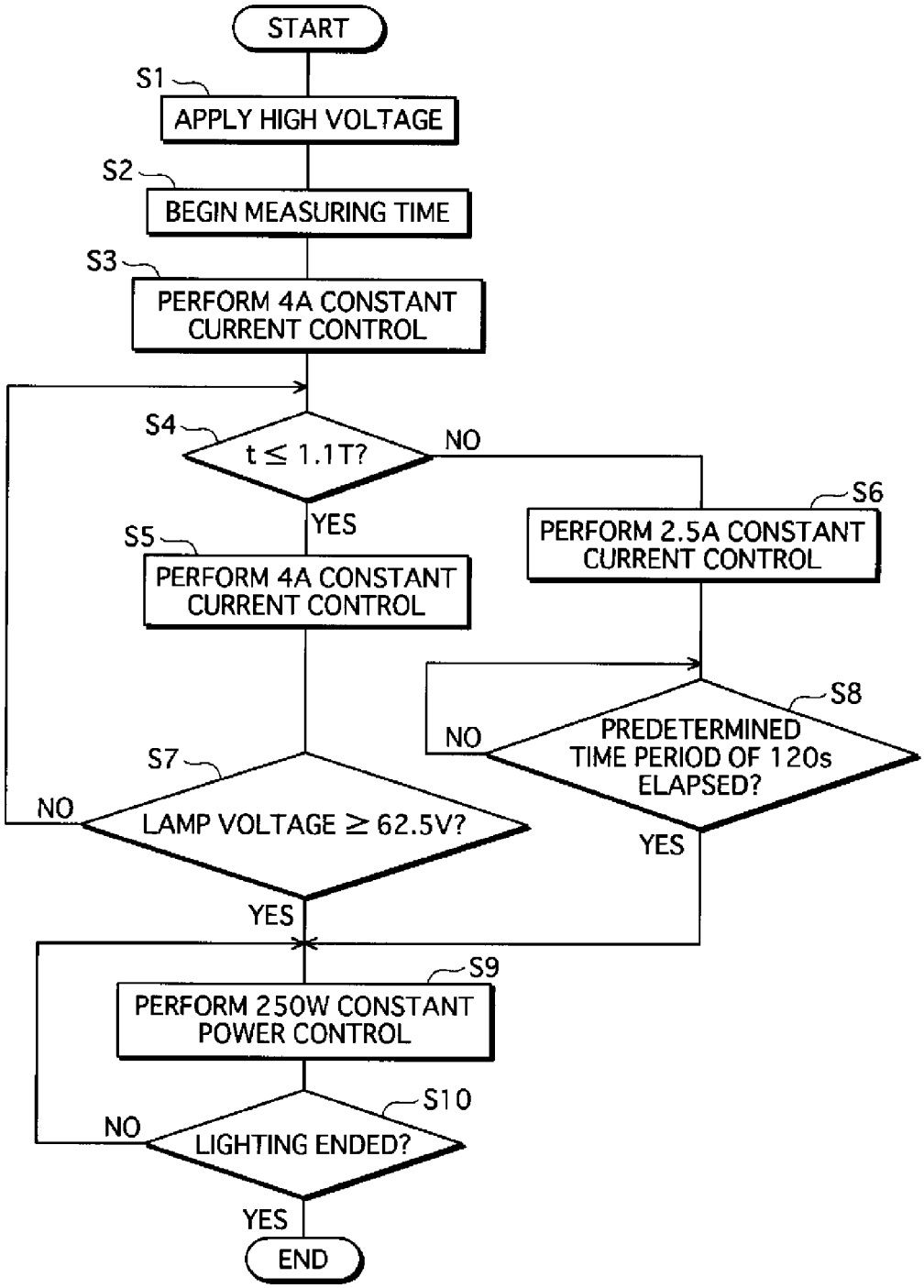

[Fig. 6]
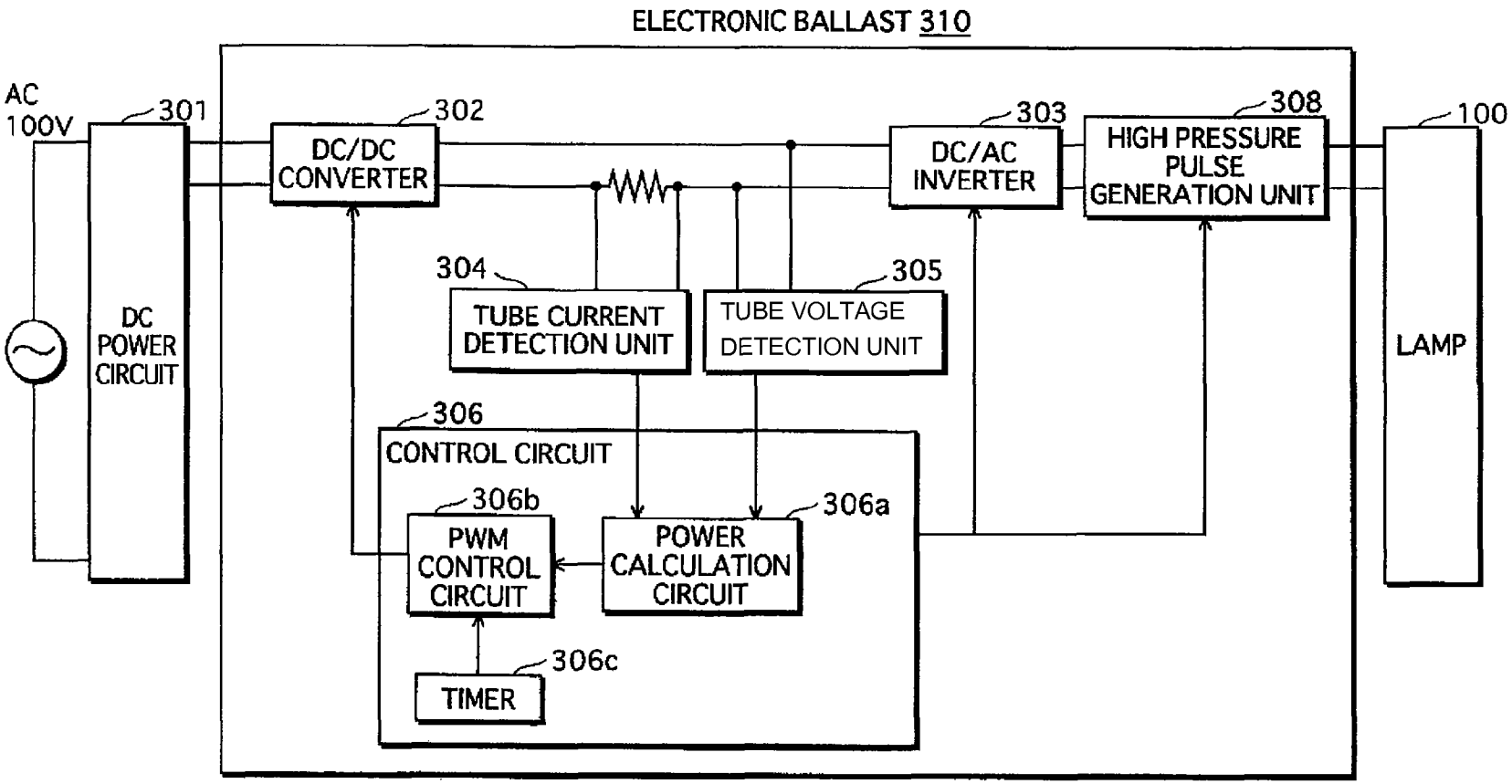

[Fig. 7]
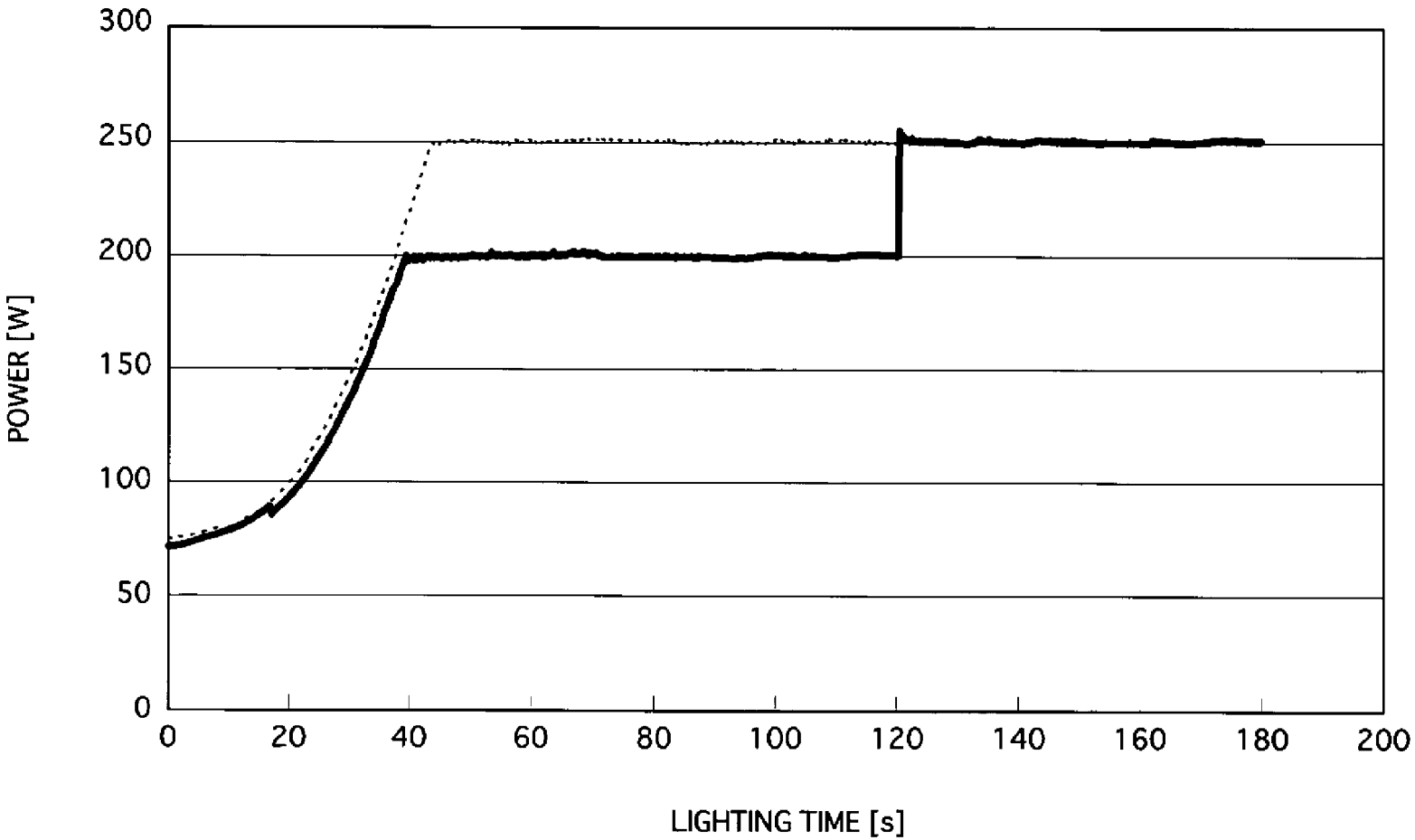

[Fig. 8]
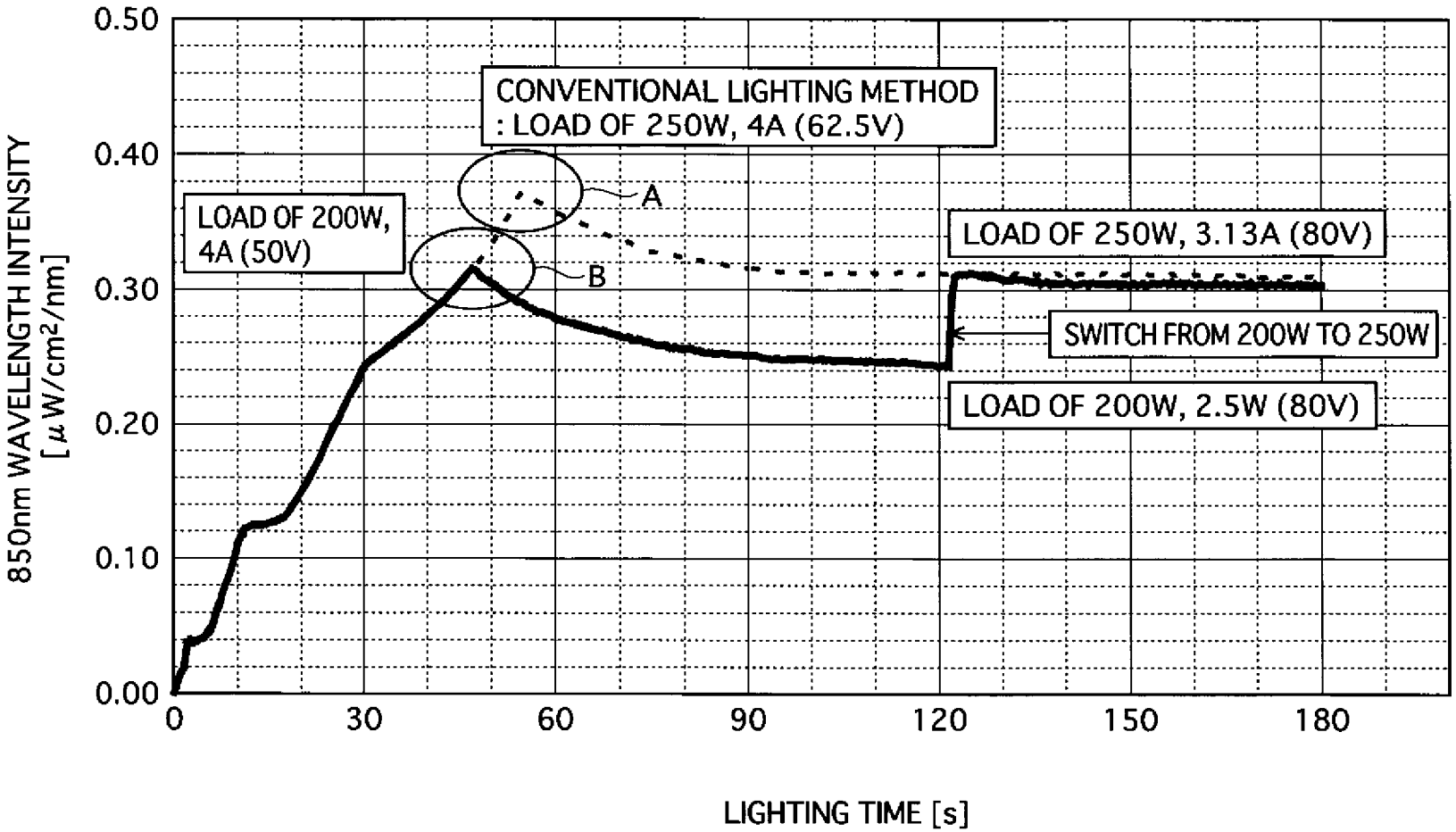

[Fig. 9]
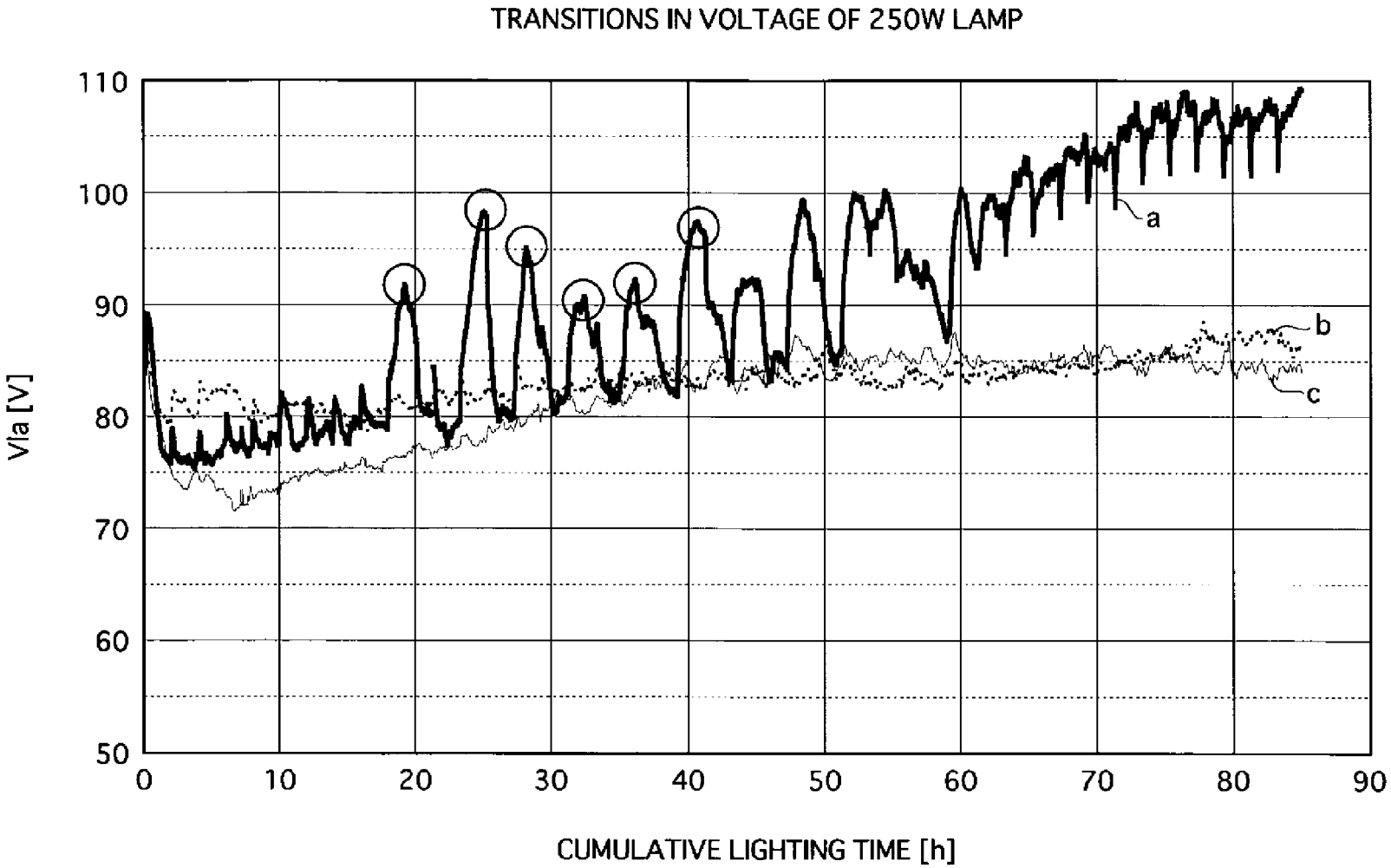

[Fig. 10A]
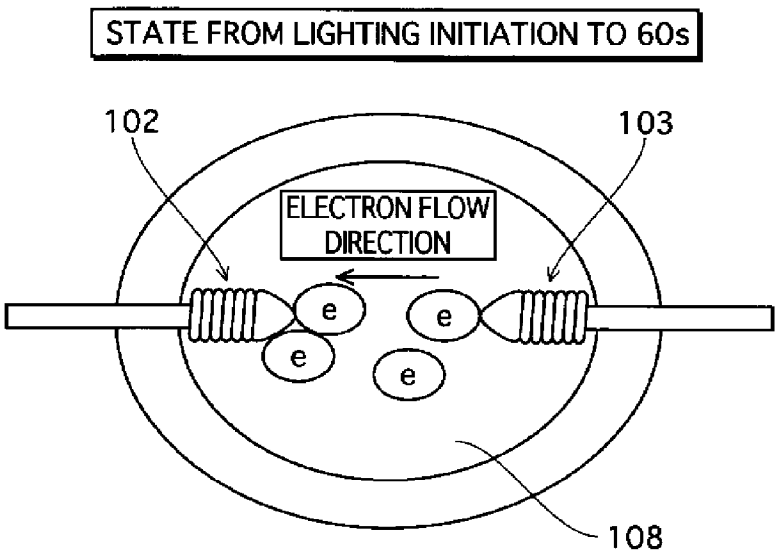
[Fig. 10B]
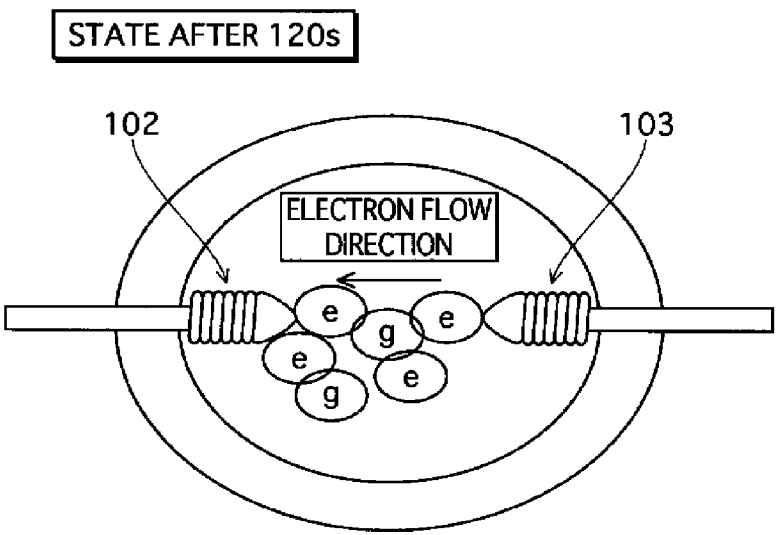

[Fig. 11]
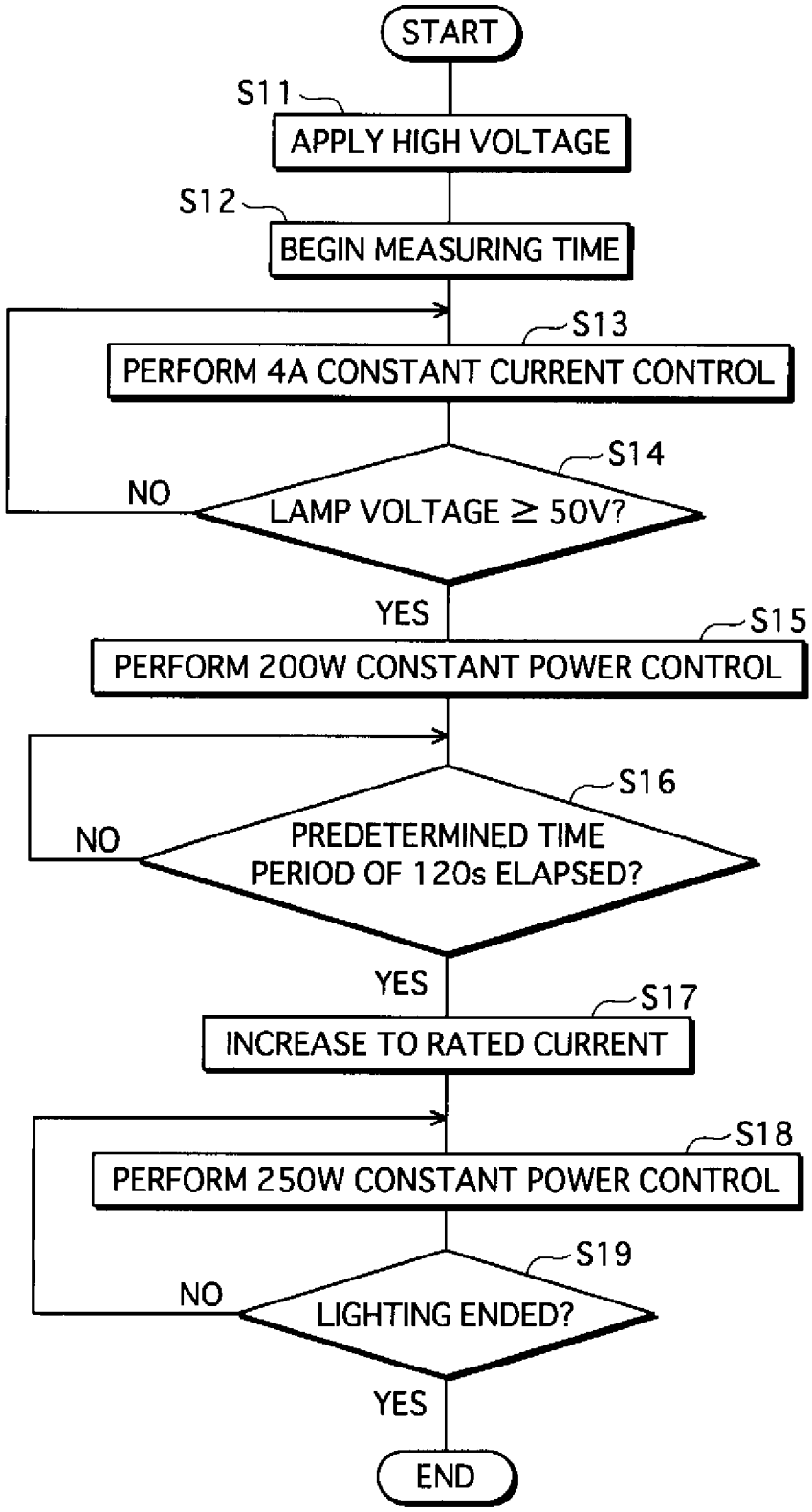

[Fig. 12]
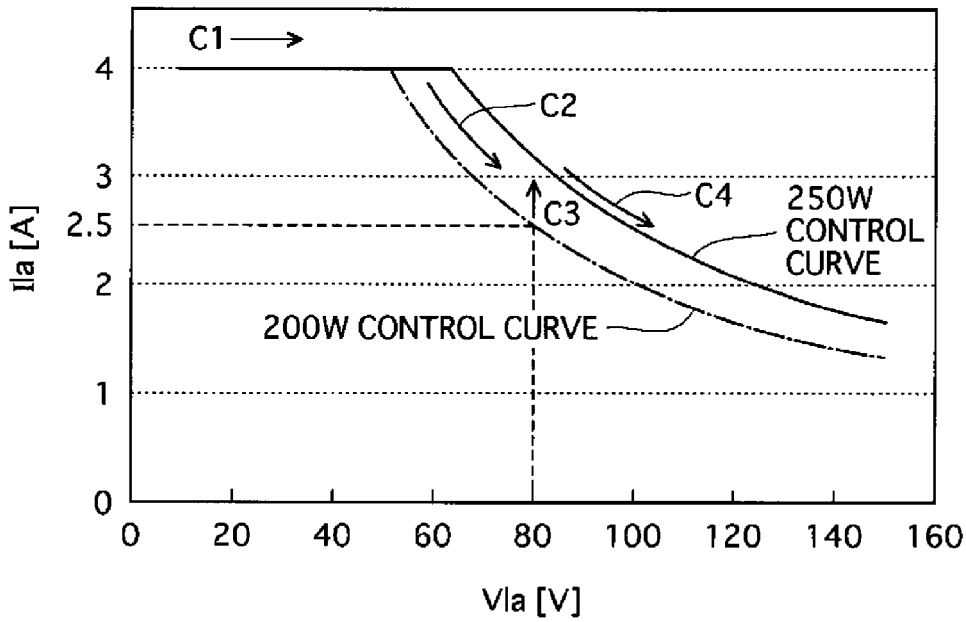
[Fig. 13A]
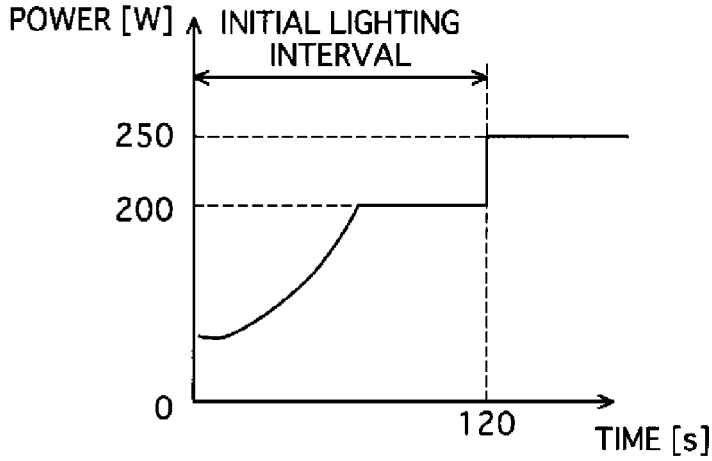

[Fig. 13B]
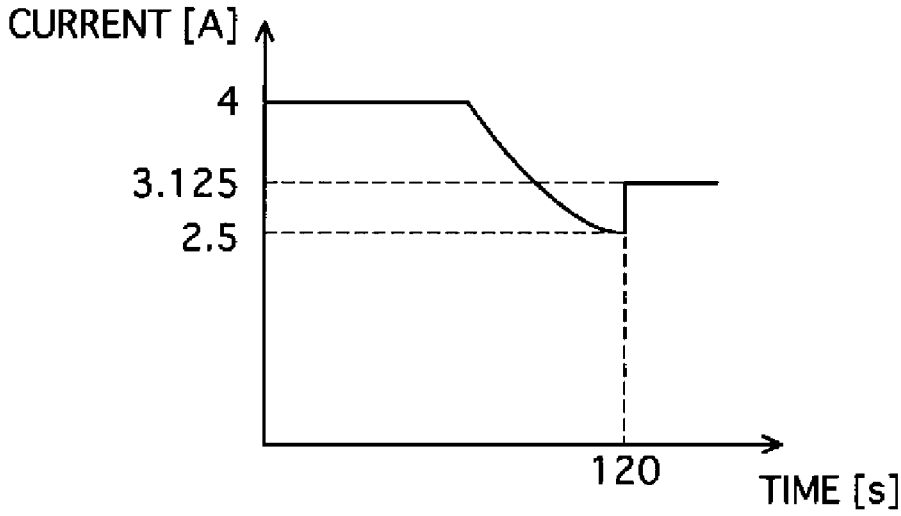
[Fig. 14A]
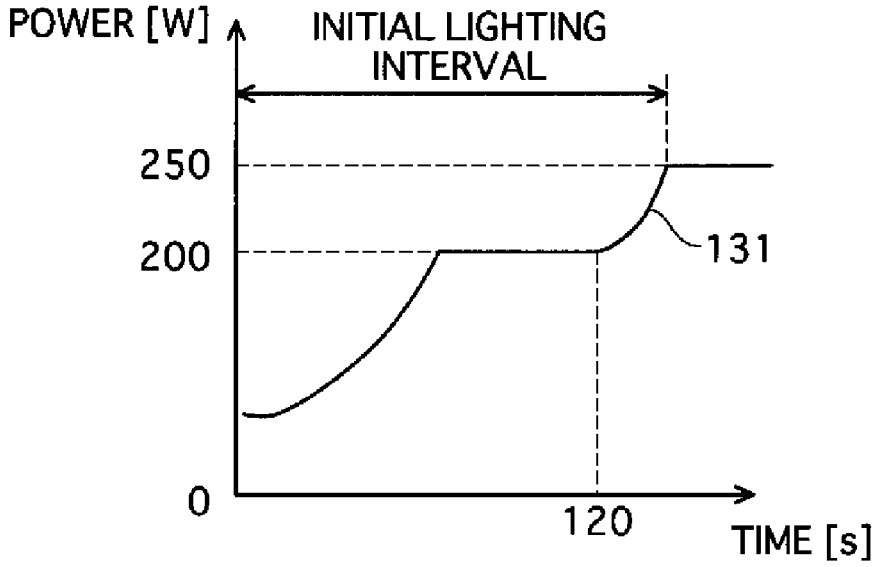

[Fig. 14B]
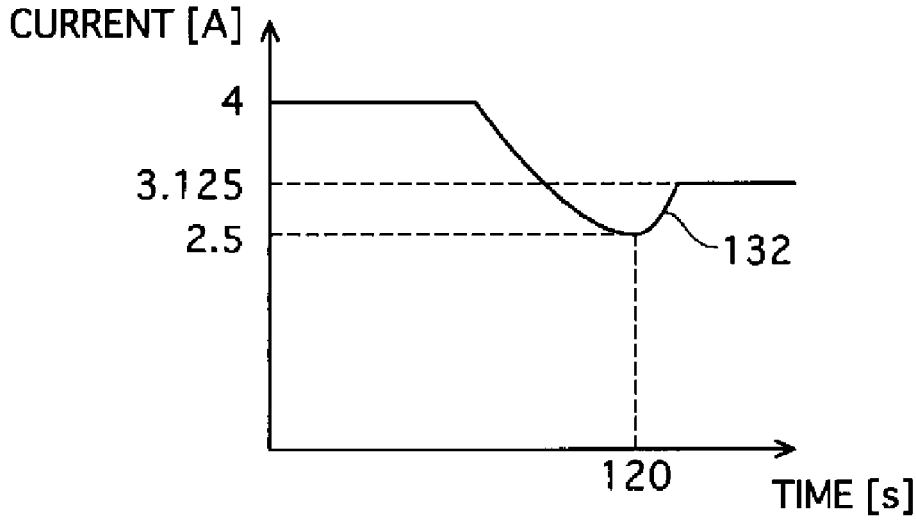

[Fig. 15]
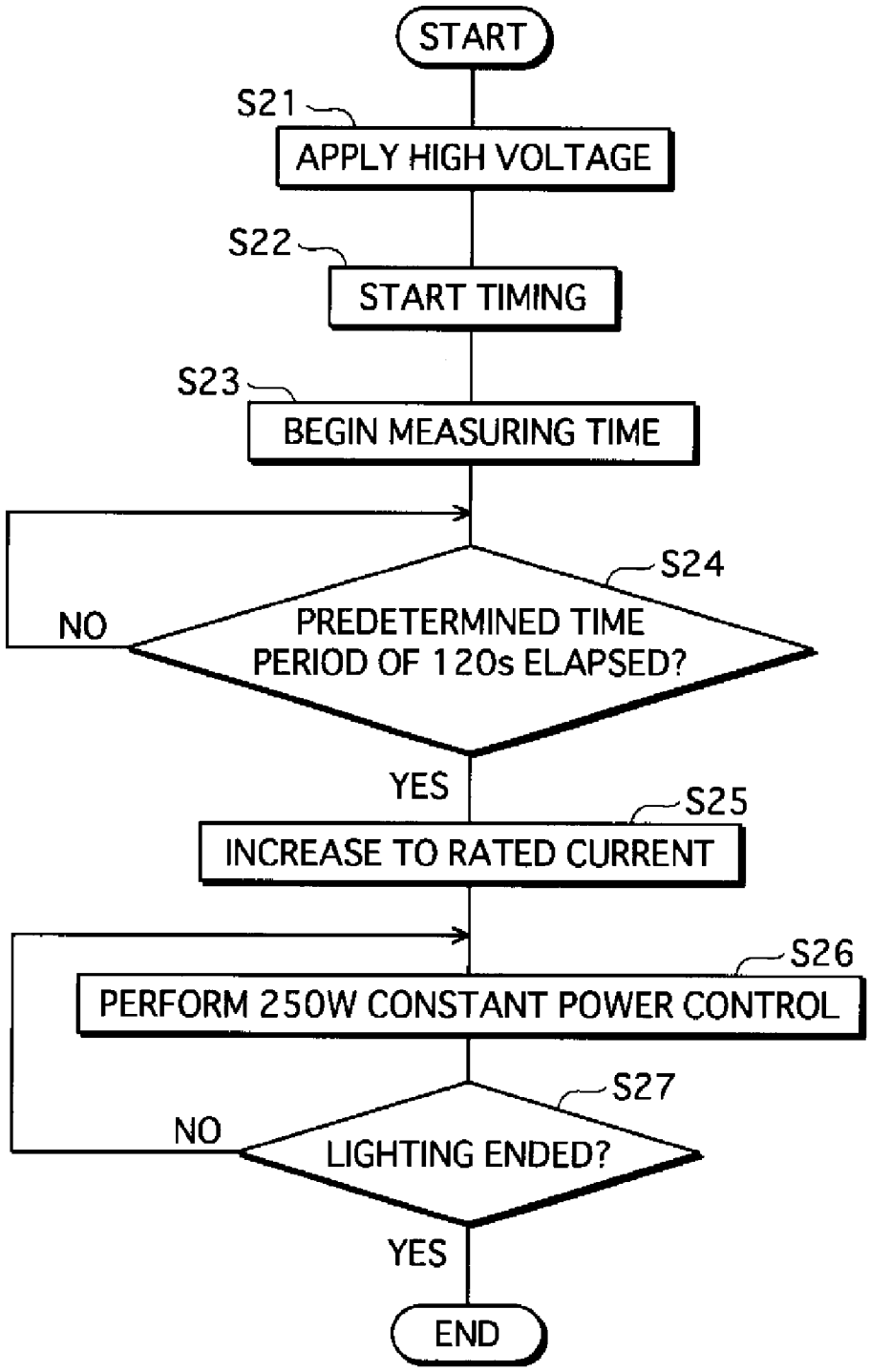

[Fig. 16A]
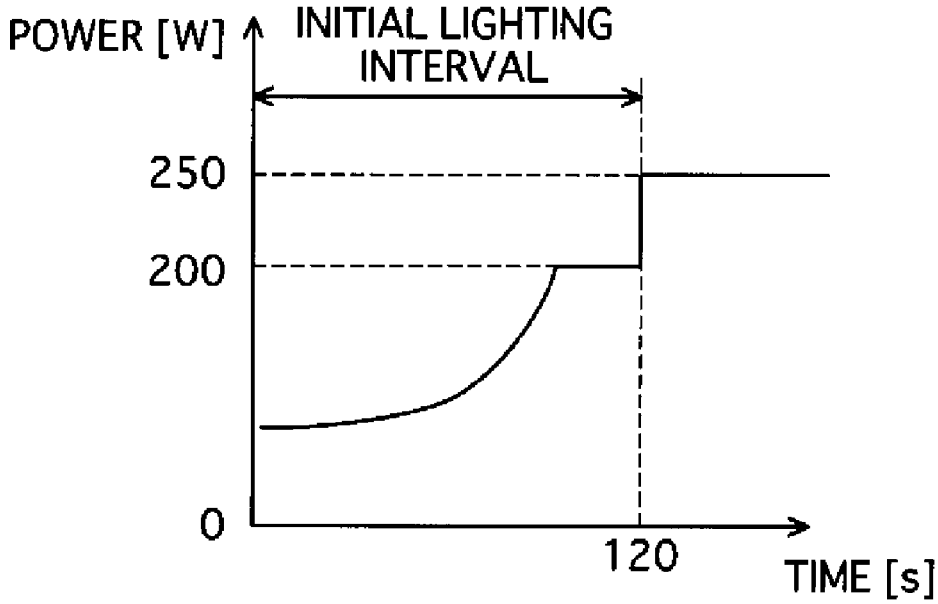
[Fig. 16B]
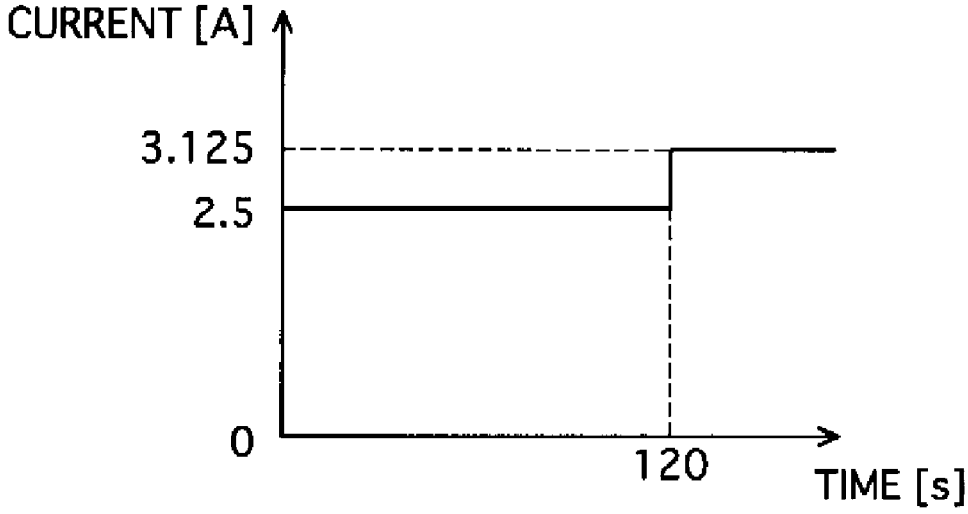

[Fig. 17A]
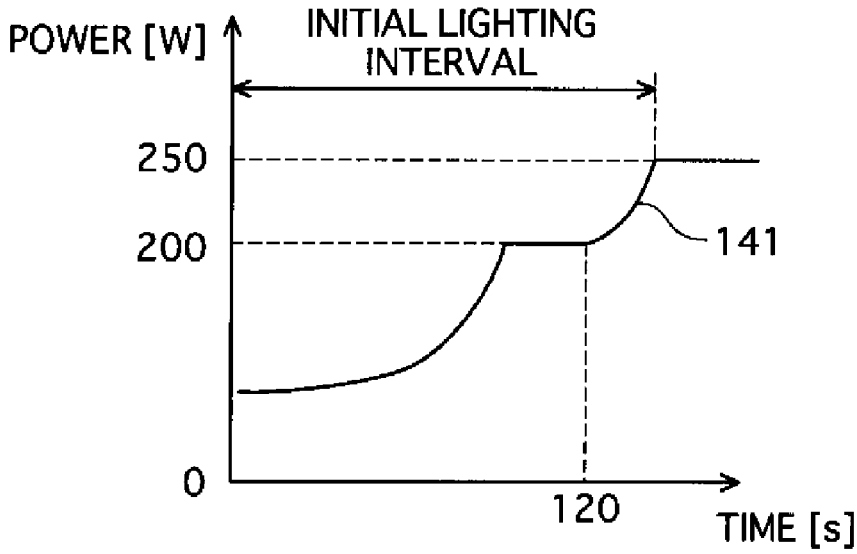
[Fig. 17B]
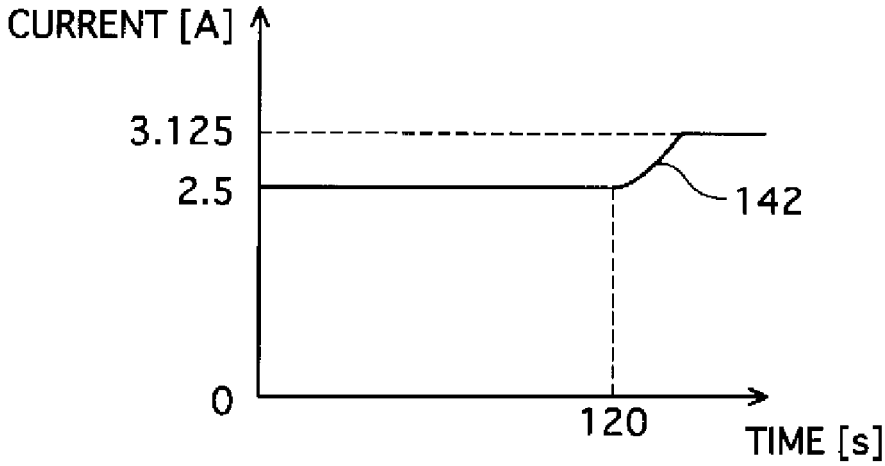

[Fig. 18]
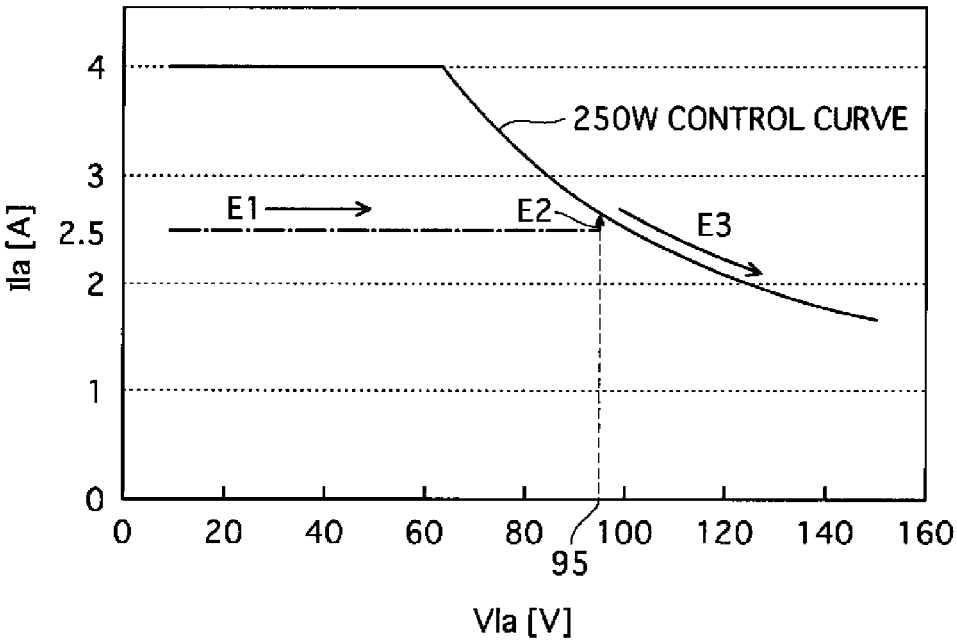

[Fig. 19]
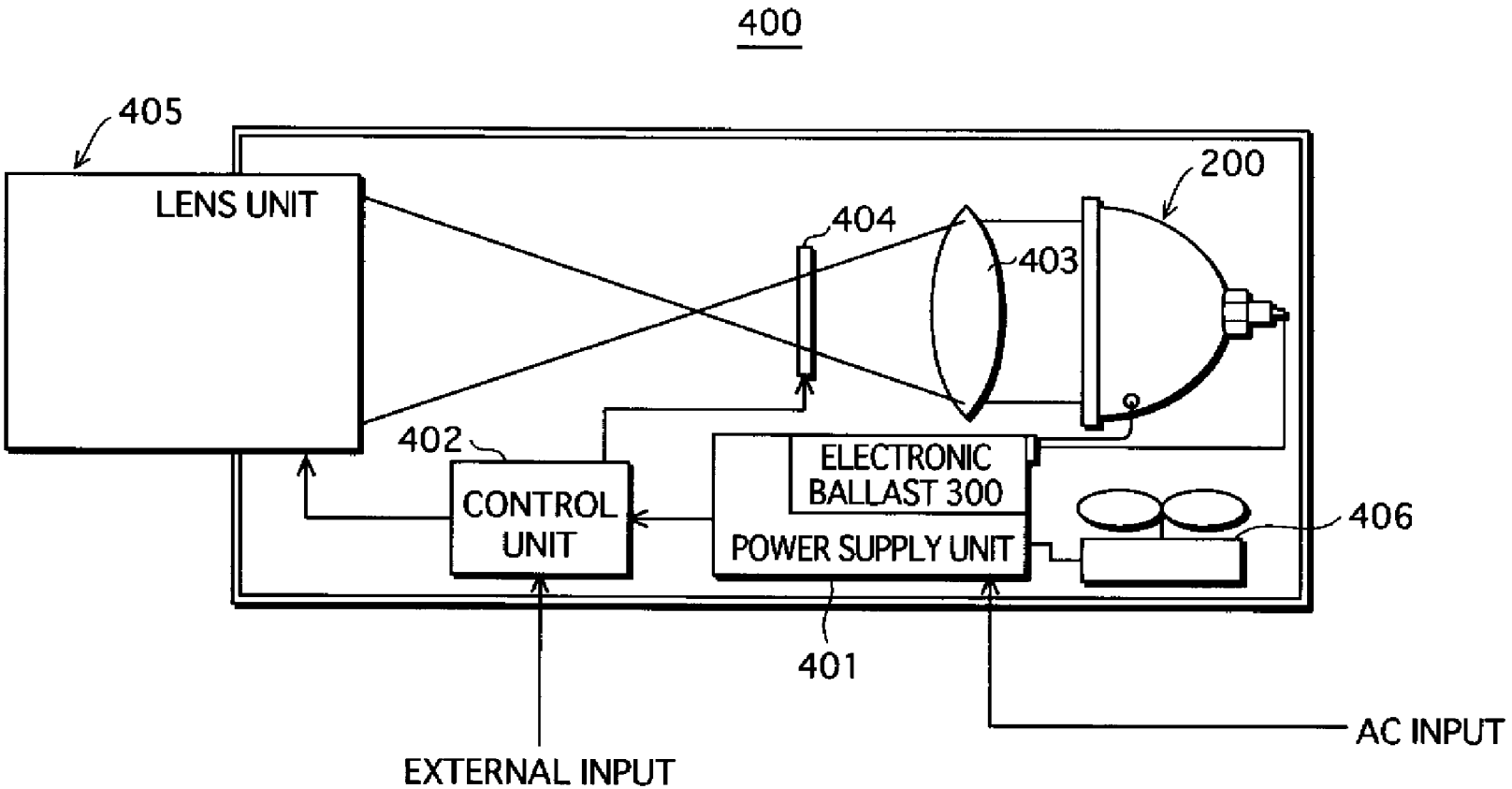

LIGHTING METHOD AND LIGHTING APPARATUS FOR A HIGH PRESSURE DISCHARGE LAMP, A HIGH PRESSURE DISCHARGE LAMP APPARATUS, AND A PROJECTION-TYPE IMAGE DISPLAY APPARATUS

RELATED APPLICATIONS

The present application claims priority from PCT Application No. PCT/JP2008/002382 filed on Aug. 29, 2008 and from the parent application Japanese Application No. 2007-226319 filed on Aug. 31, 2007.

TECHNICAL FIELD

The present invention relates to a lighting method for a high pressure discharge lamp, a lighting apparatus for a high pressure discharge lamp, a high pressure discharge lamp apparatus using the lighting apparatus, and a projection-type image display apparatus.

BACKGROUND ART

A high pressure discharge lamp includes an arc tube in which a pair of electrodes are disposed in opposition to each other, and is used as a light source in a projection-type image display apparatus such as a liquid crystal projector.

Normally, such a high pressure discharge lamp is lit by a method of lighting the lamp at a constant current value in an initial stage, and thereafter changing to constant power control by supplying a predetermined power (rated power) to the lamp (e.g., see patent citation 1).

There is demand for increased brightness (illuminance on the screen, which is hereinafter referred to as simply "illuminance") in this type of projection-type image display apparatus, and therefore various improvements in the high pressure discharge lamp included therein are required.

One example of an improvement involves the configuration of the electrodes. Specifically, the tip portions of the electrodes are formed into configurations from substantially hemispherical to substantially conical (e.g., see patent citation 2). Light beams that irradiate from the arc between the electrodes toward the electrodes are blocked by the electrodes and cannot be emitted out of the arc tube. However, the above configurations reduce the proportion of light beams that are blocked by the electrodes, thereby increasing the amount of luminous flux that is emitted out of the arc tube, and contributing to an improvement in illuminance.

Also, another method that has been proposed involves improving illuminance by raising the amount of enclosed mercury in order to increase the brightness of the high pressure discharge lamp itself.

Patent Citation 1: Japanese Patent Application Publication No. 2000-306687

Patent Citation 2: Japanese Patent Application Publication No. 2002-93363

DISCLOSURE OF INVENTION

Problems Solved by the Invention

The inventors of the present invention creating a high pressure discharge lamp including electrodes whose tip portions have a substantially conical configuration, and a high pressure discharge lamp whose enclosed amount of mercury was increased to, for example, 230 [mg/cm$^3$] or more, and then attached reflecting minors to the lamps to result in high pressure discharge lamp units. Upon lighting the high pressure discharge lamps with use of a conventional lighting apparatus and evaluating the illuminances thereof, the results of the evaluation showed that although a certain improvement in illuminance was achieved, a desired level of illuminance was not sufficiently obtained.

In order to identify the cause of the above results, the inventors of the present invention performed a detailed analysis of the high pressure discharge lamps used in the lighting evaluation, and discovered that part of the electrode tip portions had dissipated more than expected, and the inter-electrode distance (i.e., the arc length) had exceeded the design value.

Generally, the illuminance of high pressure discharge lamp units is increased by shortening the inter-electrode distance as much as possible (short-arch) in order to approximate a point light source, and then arranging the approximated point light source at the focal point of the reflecting minor on the optical axis, thereby improving the light gathering rate of the reflecting minor. When the arc length grows longer as mentioned above, a point light source fails to be approximated, as a result of which the light condensing rate decreases commensurately and a sufficient illuminance is not obtained.

Although some dissipation of part of the electrode tip portions is expected during lighting, the amount of dissipation exceeded expectation in the above cases. The cause for this is thought to be an excessive rise in the temperature of the tip of each electrode (hereinafter, referred to as the "tip temperature") during lighting. The excessive rise in temperature accelerates evaporation at the electrode tip portions, and the halogen cycle can no longer compensate for the dissipation of the electrode tip portions, thereby resulting in an increased inter-electrode distance.

The inventors of the present invention inferred the following regarding the cause of the above-described excessive rise in tip temperature.

In the case of using electrodes whose tip portions have a substantially conical configuration, normally an arc originates (an arc spot is formed) at the electrode tip portions, and the temperature of course rises at the tip portions. In this case, the cause for the excessive rise in tip temperature is thought to be the fact that heat cannot readily escape in the diameter direction of the electrodes since the electrode tip portions are tapered.

In the case of increasing the enclosed amount of mercury to 230 [mg/cm$^3$] or more, the excessive rise in tip temperature is thought to be due to a narrowing of the mercury arc itself.

The present invention has been achieved in view of the above problems, and an aim thereof is to prevent an excessive reduction in illuminance even in conditions where the tip temperature may rise as described above, by providing various improvements for increasing the brightness of a high pressure discharge lamp.

Means to Solve the Problem

In order to achieve the above aim, the inventors of the present invention performed a multifaceted study of causes for the excessive rise in the tip temperature, and discovered that a main cause lies in the lighting control.

Specifically, the inventors of the present invention found that the current value in the constant current control performed after lighting commencement is larger than the current value during stable lighting (during constant power control at the rated power), and therefore after changing from constant current control to constant power control at the rated power, the tip temperature is much greater than the temperature during stable lighting (see FIG. 8 which is described later).

Therefore, in the case of using electrodes whose tip portions have a substantially hemispherical configuration, and in the case where the enclosed amount of mercury is, for example, 200 [mg/cm$^3$] or less, the tip temperature after changing from constant current control to constant power control at the rated power is thought to exceed the temperature during stable lighting.

Although the above phenomena are thought to occur in these cases as well, they are not problematic since they occur to a very small extent and are therefore within a permissible range for practical purposes.

However, in the case of using electrodes whose tip portions have a substantially conical configuration, and in the case where the enclosed amount of mercury is, for example, 230 [mg/cm$^3$] or more, the above problems become significant since the extent of the phenomena exceeds the permissible range.

Taking the above findings into account, the inventors of the present invention have proposed performing control so that the tip temperature after changing from constant current control to constant power control at the rated power does not greatly exceed the temperature during stable lighting.

Specifically, a first aspect of the present invention is a lighting method for lighting a high pressure discharge lamp having an arc tube in which mercury is enclosed as a light-emitting material and in which a pair of electrodes are arranged, including the steps of: commencing lighting by applying a predetermined voltage to the pair of electrodes to cause dielectric breakdown to occur therebetween; performing lighting warm-up by, in an initial lighting interval from lighting commencement to constant power control at a rated power value Ps [W] of the high pressure discharge lamp, controlling a lamp power supplied to the high pressure discharge lamp according to a predetermined condition; and performing stable lighting to cause the high pressure discharge lamp to be lit stably by performing constant power control at the rated power value Ps [W], wherein in the lighting warm-up step, the lamp power is controlled according to the predetermined condition that a relational expression t [degrees C.]<=1.1 T [degrees C.] is satisfied, where t [degrees C.] is an electrode tip temperature in the initial lighting interval and T [degrees C.] is the electrode tip temperature during stable lighting.

A second aspect of the present invention is a lighting method for lighting a high pressure discharge lamp having an arc tube in which mercury is enclosed as a light-emitting material and in which a pair of electrodes are arranged, including the steps of: commencing lighting by applying a predetermined voltage to the pair of electrodes to cause dielectric breakdown to occur therebetween; performing lighting warm-up by, in an initial lighting interval from lighting commencement to constant power control at a rated power value Ps [W] of the high pressure discharge lamp, controlling a lamp power supplied to the high pressure discharge lamp according to a predetermined condition; and performing stable lighting to cause the high pressure discharge lamp to be lit stably by performing constant power control at the rated power value Ps [W], wherein in the lighting warm-up step, the lamp power is controlled according to the predetermined condition that the initial lighting interval includes a lower-power lighting interval in which lighting is sustained at a constant power value Pa [W] that is lower than the rated power value Ps [W].

Here, the lighting warm-up step may include: a first sub-step of performing constant current control at a current value Ia [A]; a second sub-step of performing constant power control at the power value Pa [W] when a lamp voltage of the high pressure discharge lamp reaches a value Va [V]; and a third sub-step of changing to constant power control at the rated power value Ps [W] upon elapse of a predetermined time period beginning at lighting commencement, a relational expression Ia [A]*Va [V]=Pa [W] may be satisfied, and the second sub-step may be performed in the lower-power lighting interval.

Also, the lighting warm-up step may include: a first sub-step of performing constant current control at a current value Ib [A], a lamp voltage range being specified as a design property of the high pressure discharge lamp, and the current value Ib [A] being determined so that a relational expression Ib [A]*Vb [V]<Ps [W] is satisfied, where Vb [V] is a current value that is an upper limit of the specified lamp voltage range; and a second sub-step of changing to constant power control at the rated power value Ps [W] upon elapse of a predetermined time period beginning at lighting commencement, and the lower-power lighting interval may be an interval from when the lamp voltage reaches a lamp voltage Vc [V] to before when the second sub-step is performed, the lamp voltage Vc [V] being in the lamp voltage range and being a maximum lamp voltage unique to the high pressure discharge lamp targeted for lighting in the first sub-step.

Furthermore, it is desirable for the power value Pa [W] in the lower-power lighting interval to be in a range of 70% to 90% inclusive of the rated power value Ps [W].

A third aspect of the present invention is a lighting apparatus for lighting a high pressure discharge lamp having an arc tube in which mercury is enclosed as a light-emitting material and in which a pair of electrodes are arranged, the lighting apparatus including: a power supply unit operable to supply power to the high pressure discharge lamp; and a control unit operable to (a) commence lighting by causing the power supply unit to apply a predetermined voltage to the pair of electrodes to cause dielectric breakdown to occur therebetween, (b) in an initial lighting interval from lighting commencement to constant power control at a rated power value Ps [W] of the high pressure discharge lamp, control the power supply unit to supply a lamp power to the high pressure discharge lamp according to a predetermined condition, and (c) cause the high pressure discharge lamp to be lit stably by performing constant power control at the rated power value Ps [W], wherein the control unit controls the power supply unit to supply the lamp power according to the predetermined condition that a relational expression t [degrees C.]<=1.1 T [degrees C.] is satisfied, where t [degrees C.] is an electrode tip temperature in the initial lighting interval and T [degrees C.] is the electrode tip temperature during stable lighting.

A fourth aspect of the present invention is a lighting apparatus for lighting a high pressure discharge lamp having an arc tube in which mercury is enclosed as a light-emitting material and in which a pair of electrodes are arranged, the lighting apparatus including: a power supply unit operable to supply power to the high pressure discharge lamp; and a control unit operable to (a) commence lighting by causing the power supply unit to apply a predetermined voltage to the pair of electrodes to cause dielectric breakdown to occur therebetween, (b) in an initial lighting interval from lighting commencement to constant power control at a rated power value Ps [W] of the high pressure discharge lamp, control the power supply unit to supply a lamp power to the high pressure discharge lamp according to a predetermined condition, and (c) cause the high pressure discharge lamp to be lit stably by performing constant power control at the rated power value Ps [W], wherein the control unit controls the power supply unit to supply the lamp power according to the predetermined condition that the initial lighting interval includes a lower-power lighting interval in which lighting is sustained at a constant power value Pa [W] that is lower than the rated power value Ps [W].

A fifth aspect of the present invention is a high pressure discharge lamp apparatus including a high pressure discharge lamp, a reflecting mirror that reflects light emitted from the high pressure discharge lamp, and the above-described lighting apparatus for a high pressure discharge lamp.

A sixth aspect of the present invention is a projection-type image display apparatus including the above-described high pressure discharge lamp apparatus.

Effects of the Invention

The present invention performs control so as to prevent an excessive rise in the temperature of electrode tip portions even if various improvements made to increase brightness cause a tendency for the tip temperature to rise, thereby suppressing an increase in arc length and preventing a reduction in illuminance.

BRIEF DESCRIPTION OF THE DRAWINGS

FIG. 1 shows a schematic structure of a high pressure mercury lamp.

FIG. 2 is a partially cut-away perspective view showing the structure of a lamp unit using the high pressure mercury lamp.

FIG. 3 shows the structure of an electronic ballast pertaining to embodiment 1.

FIG. 4 is an image of an electrode tip portion captured by an infrared camera.

FIG. 5 is a flowchart showing a lighting method pertaining to embodiment 1.

FIG. 6 shows the structure of an electronic ballast pertaining to embodiment 2.

FIG. 7 is a graph showing a relationship between power and lighting time in an initial lighting stage of a lamp.

FIG. 8 is a graph showing a relationship between lighting time and an intensity of 850 [nm] wavelength light in a proximity of the electrode tip portion.

FIG. 9 is a graph showing transitions in lamp voltage over cumulative lighting time.

FIG. 10A shows a state of electrons and gas in an arc tube.

FIG. 10B shows a state of electrons and gas in an arc tube.

FIG. 11 is a flowchart showing a lighting method pertaining to control example 1 of embodiment 2.

FIG. 12 shows a control curve in control example 1

FIG. 13A is a graph showing transitions in power in control example 1.

FIG. 13B is a graph showing transitions in current in control example 1.

FIG. 14A is a graph showing transitions in power in control example 1, when a time constant has been introduced.

FIG. 14B is a graph showing transitions in current in control example 1, when a time constant has been introduced.

FIG. 15 is a flowchart showing a lighting method pertaining to control example 2 of embodiment 2.

FIG. 16A is a graph showing transitions in power in control example 2.

FIG. 16B is a graph showing transitions in current in control example 2.

FIG. 17A is a graph showing transitions in power in control example 2, when a time constant has been introduced.

FIG. 17B is a graph showing transitions in current in control example 2, when a time constant has been introduced.

FIG. 18 shows an exemplary control curve in control example 2.

FIG. 19 is a block diagram showing the structure of a liquid crystal projector.

BEST MODE FOR CARRYING OUT THE INVENTION

The following describes embodiments of the present invention with reference to the drawings.

Embodiment 1

1. High Pressure Discharge Lamp

FIG. 1 shows the structure of a high pressure mercury lamp (hereinafter, simply called a "lamp") 100 having a rated power of 250 [W], as one example of a high pressure discharge lamp. For the sake of simplicity, FIG. 1 is a sectional view in which electrodes are exposed.

As shown in FIG. 1, the lamp 100 is constituted from a quartz arc tube 101 that includes a spheroidal light-emitting portion 101*a* and sealing portions 101*b* and 101*c* formed at respective ends of the light-emitting portion 101*a*.

Enclosed inside a light-emitting space 108 in the light-emitting portion 101*a* is mercury 109 as a light-emitting material, a rare gas such as argon, krypton, or xenon for aiding start-up, and a halogen material such as iodine or bromine. In this case, the enclosed amount of mercury 109 is set in the range of 230 [mg/cm$^3$] to 650 [mg/cm$^3$] per interior volume of the arc tube 101, and the enclosed pressure of the rare gas is set in the range of 0.01 [MPa] to 1 [MPa] when the lamp is cool.

Also, a pair of tungsten (W) electrodes 102 and 103 are arranged substantially in opposition to each other in the light-emitting portion 101*a*.

Tip portions 124 and 134 of the electrodes 102 and 103 have a substantially conical configuration. A substantially conical configuration is used in the present embodiment because a substantially hemispherical configuration, for example, would lead to a slight reduction in the luminous flux emitted externally, due to the bulging part of the hemisphere blocking light that is irradiated toward it.

Inter-electrode distance De, which is the length of the gap between the tip portions 124 and 134 of the electrodes 102 and 103, is set in the range of 0.5 [mm] to 2.0 [mm] in order to approximate a point light source. Note that in the lamp 100 of the present embodiment, projections (not depicted) are formed on the electrode tip portions 124 and 134 when product manufacturing is completed, and the range of 0.5 [mm] to 2.0 [mm] is preferably set as the inter-electrode distance De in a state where the projections have been formed to a reasonable length.

The electrodes 102 and 103 are electrically connected to molybdenum foil 104 and 105 sealed in the sealing portions 101*b* and 101*c*.

The molybdenum foil 104 and 105 are connected to external lead wires 106 and 107 that extend out of the arc tube 101 from the end faces of the sealing portions 101*b* and 101*c*.

Note that bromine is enclosed as the halogen material in the discharge space 108 in a range of $1*10^{-10}$ [mol/cm$^3$] to $1*10^{-4}$ [mol/cm$^3$]. Bromine is enclosed in the discharge space 108 in order to suppress darkening of the inner face of the light-emitting portion 101*a*, by enabling the halogen cycle effect in which tungsten evaporates off the electrodes 102 and 103 and is then re-deposited on the electrodes 102 and 103, and in order to prevent an increase in the arc length due to receding of the electrode tip portions. The enclosed amount of bromine, which most effectively enables the halogen cycle effect, is preferably in the range of $1*10^{-9}$ [mol/cm$^3$] to $1*10^{-5}$ [mol/cm$^3$] inclusive.

2. Lamp Unit

FIG. 2 is a partially cut-away perspective view showing the structure of a lamp unit 200 in which the lamp 100 has been mounted.

As shown in FIG. 2, in the lamp unit 200, a base 201 has been mounted to one end of the arc tube 101 constituting the lamp 100, and the base 201 has been attached to a reflecting mirror 203 via a spacer 202. Note that the base 201 has been attached in a manner such that the position of the discharge arc of the lamp 100 exists on the optical axis of the reflecting mirror 203.

Current is supplied to the electrodes of the lamp 100 via a terminal 204 and a lead wire 205 that extends outward from one of the electrodes and passes through a through-hole 206 that pierces through the reflecting mirror 203.

A compact infrared camera 208 is embedded, via a metal sleeve 209, in a through-hole 207 that pierces through the reflecting mirror 203. The direction of the compact infrared camera 208 and the focus of a lens 208*a* are set so that the compact infrared camera 208 captures images of the tip portion 124 of the electrode 102 (or the tip portion 134 of the electrode 103). Here, the imaging direction of the infrared camera 208 is desirably set to be orthogonal to the axis of the electrode 102.

In consideration of the fact that the lamp 100 reaches high temperatures, the metal sleeve 206 is provided for heat dissipation so that the infrared camera 208 does not overheat and become damaged. Furthermore, an air blowing means may be separately provided to blow air into the space surrounded by the reflecting mirror 203 of the lamp unit 200.

Note that when the lamp 200 is mounted in an image display apparatus or the like, the lamp 200 is desirably attached to the main body of the apparatus in a manner such that the infrared camera 208 is not in a position above the lamp 100, nor in a position directly below the lamp 100.

Also, in order to reliably protect the infrared camera 208 from heat, the infrared camera 208 may be installed in a location away from the lamp 200, and may capture images of the electrode tip portion via an optical fiber. The method employed to protect the infrared camera 208 from heat should be selected according to the heat resistance properties of the actual infrared camera 208 that is used.

Regardless of the method employed, the infrared camera 208 is expensive, and when replacing the lamp unit 200, the infrared camera 208 should desirably be able to be removed and used in a new lamp unit 200.

3. Lighting Apparatus

Electronic Ballast

FIG. 3 shows the structure of an electronic ballast 300 for lighting the lamp 100.

As shown in FIG. 3, the electronic ballast 300 includes a DC/DC converter 302, a DC/AC inverter 303, a tube current detection unit 304, a tube voltage detection unit 305, a control circuit 306, and a high voltage pulse generation unit 308.

A DC power circuit 301 includes, for example, a rectifier circuit. The DC power circuit 301 generates a DC voltage from household 100 [V] AC and supplies the DC voltage to the electronic ballast 300.

The DC/DC converter 302 supplies DC having a predetermined voltage to the DC/AC inverter 303.

The DC/AC inverter 303 generates a square wave AC having a predetermined frequency in accordance with a control signal received from the control circuit 306.

The high voltage pulse generation unit 308 includes, for example, a transformer. The high voltage pulse generation unit 308 generates and applies a high voltage to the lamp 100.

The control circuit 306 performs overall control of the DC/DC converter 302, the DC/AC inverter 303, etc. The control circuit 306 includes a power calculation circuit 306*a*, a PWM control circuit 306*b*, a timer 306*c*, a comparison unit 306*d*, and a temperature calculation unit 306*e*.

The power calculation unit 306*a* calculates the lamp power based on a lamp current and lamp voltage detected by the tube current detection unit 304 and tube voltage detection unit 305 respectively.

The PWM control circuit 306*b* controls current etc. by performing pulse-width modulation.

The timer 306*c* measures time from lighting commencement.

The temperature calculation unit 306*e* acquires the tip temperature by analyzing an image of the electrode tip portion 124 captured by the infrared camera 208 and obtaining a temperature distribution of the electrode tip portion 124.

FIG. 4 schematically shows an image of the electrode tip portion 124 captured by the infrared camera 208 and an exemplary temperature distribution of the electrode tip portion 124. In FIG. 4, the X axis indicates the direction of the electrode axis, and T1 to TN indicate an exemplary temperature distribution that has been detected.

The temperature calculation unit 306*e* acquires the tip temperature by processing the image of the electrode tip portion 124 and extracting a contour line 124*a*, and reading the temperature of tip P based on the detected temperature distribution.

The extraction of the contour line in the image can be achieved by, for example, scanning the pixels of the captured image data with use of a known edge-detection filter, and the tip P can be found by searching for the pixel on the contour line 124*a* whose position is front-most in the X axis direction (farthest right in FIG. 4).

Note that in the present embodiment, the temperature calculation unit 306*e* actually acquires the temperature at a point that is a predetermined distance D1 (e.g., 0.1 [mm]) inward from the detected tip P in the X axis direction. Ideally, the temperature at the exact tip of the electrode tip portion 124 should be measured. However, if the measured position shifts outward even slightly, there would be a large error in the measurement, and therefore the temperature is acquired at a position slightly inward in the X axis direction in order to reliably detect the temperature at the electrode tip portion. Here, since the predetermined distance D1 is set to a very low value of "0.1 [mm]", the measured temperature can be viewed as substantially the same as the temperature of the exact tip, and there are no control issues.

The comparison unit 306*d* compares the tip temperature calculated at the initial lighting stage and the tip temperature during stable lighting, and sends a control signal to the PWM control circuit 306*b* based on the result of the comparison. Details of the lighting method are described below.

4. Lighting Method

As previously mentioned, the results of the investigation performed by the inventors of the present invention show that when changing to constant power control at the rated power after lighting commencement, the tip temperature is much greater than the temperature during stable lighting.

Let us assume that t [degrees C.] is the tip temperature during an initial lighting interval, which is a warming-up interval from after lighting commencement until reaching the rated power, and that T [degrees C.] is the tip temperature during stable lighting. In the present embodiment, performing control so that t [degrees C.] does not greatly exceed T [degrees C.] enables preventing dissipation of and damage to the electrode tip portions due to an excessive rise in temperature.

Experiments performed by the inventors of the present invention confirmed that when t [degrees C.]>1.1 T [degrees C.], the dissipation of and damage to the electrode tip portions exceeds the permissible range for practical purposes, and therefore temperature control is preferably performed so as to maintain the relationship t [degrees C.]<=1.1 T [degrees C.].

FIG. 5 is a flowchart showing a concrete example of control in the lighting method of embodiment 1. The control shown in FIG. 5 is performed by the control circuit 306 (FIG. 3) of the electronic ballast 300.

First, the high voltage pulse generation unit 308 generates and applies a high voltage between the electrodes 102 and 103 in the lamp 100 to cause dielectric breakdown and start a discharge (step S1), and the timer 306*c* begins measuring time (step S2).

Thereafter, the control circuit 306 performs constant current control so that a constant first current value I1 [A] (4 [A] in the present example) flows between the electrodes 102 and 103 (step S3), and then processing moves to the temperature control loop of steps S4 to S8.

Specifically, if the temperature t [degrees C.] of the tip portion 124 of the electrode 102 being monitored by the infrared camera 208 is less than or equal to 1.1 T [degrees C.] (step S4: YES), the control circuit 306 continues to perform 4 [A] constant current control (step S5). When the lamp voltage becomes greater than or equal to 62.5 [V], the temperature control loop ends, and the control circuit 306 changes to constant power control at a power rating value of Ps [W] (step S7: YES, step S9). In the present example, the power rating value Ps is 250 [W] (=62.5 [V]*4 [A]). The control circuit 306 continues to perform the constant power control until lighting has ended (step S10).

In step S4, if the electrode tip temperature t [degrees C.] is greater than 1.1 T [degrees C.] (step S4: NO), the control circuit 306 changes to constant current control at a second current value I2 [A] that is smaller than the first current value I1 [A] (step S6). In the present example, the second current value I2 [A] is 2.5 [A]. Lowering the current value of the constant current control in this way reduces the tip temperature and enables maintaining the relationship t [degrees C.]<=1.1 T [degrees C.].

Then, when 120 seconds has elapsed, the control circuit 306 changes to constant power control at the rated power value Ps [W] (250 [W]) (step S8: YES, step S9), and continues to perform the constant power control until lighting has ended (step S10).

Note that if the responsiveness of the control circuit 306 is slow in the judgment of step S4, it can be assumed that there will be a time lag etc. in the control. To be safe, the relationship may be set to, for example, "t [degrees C.]<=1.05 T [degrees C.]" in order to cause the control circuit 306 to change to the second current value I2 [A] at a sooner timing in step S4.

The first current value I1 [A] and second current value I2 [A] are not limited to 4 [A] and 2.5 [A] respectively, provided that the relationship I1 [A]>I2 [A] is maintained and the difference between I1 [A] and I2 [A] is large enough to enable performing control to prevent the electrode tip temperature t [degrees C.] from exceeding 1.1 T [degrees C.] at both current values. Specifically, the time required for lighting warm-up is too long if the first current value I1 [A] is too small, and therefore it is empirically preferable to maintain the relationship 3 [A]<=I1 [A]<=5 [A]. Also, if the second current value I2 [A] is too small, there is a large difference in illuminance when changing to stable lighting, which is unpleasant. Therefore, the current value is desirably set suitably so that when processing moves to step S6, the lamp power is in the range of 70% to 90% of the rated power value.

Specific first and second current values that satisfy the above conditions may be obtained by, for example, performing experimentation in advance according to the rated power of the high pressure discharge lamp to be lit.

Also, as is described later, the threshold of the time measured in step S8 is not limited to 120 seconds, but instead can be another suitable value.

In this way, according to the lighting method for the high pressure discharge lamp of the present embodiment, the tip temperature of the electrode 102 is monitored in the interval from lighting commencement until reaching the rated power, and the value of the current flowing between the electrodes 102 and 103 is changed according to the electrode tip temperature t [degrees C.], thus realizing control so that the electrode tip temperature t [degrees C.] during the above interval and the electrode tip temperature T [degrees C.] during stable lighting satisfy the relationship t [degrees C.]<=1.1 T [degrees C.]. The lighting method of the present embodiment enables preventing the temperature of the electrode tips from rising excessively during lighting warm-up, thereby suppressing a reduction in illuminance due to an increase in arc length.

5. Liquid Crystal Projector

The above-described lamp unit 200 can be mounted and used in a projection-type image display apparatus.

FIG. 19 shows a schematic structure of a liquid crystal projector 400 as one example of a projection-type image display apparatus.

As shown in FIG. 19, the transmissive-type liquid crystal projector 400 includes a power supply unit 401, a control unit 402, a condensing lens 403, a lens 405 in which a transmissive-type color liquid crystal display plate 404 and a drive motor are included, and a cooling fan 406.

The power supply unit 401 converts a commercial AC input (100 [V]) to a predetermined DC voltage, and supplies the predetermined DC voltage to the control unit 402.

The control unit 402 causes a color image to be displayed by driving the color liquid crystal display plate 404 based on an image signal received from an external device. Also, the control unit 402 performs focusing operations and zooming operations by control the drive motor in the lens unit 405.

Light irradiated from the lamp unit 200 is condensed by the condensing lens 403 and passes through the color liquid crystal display plate 404 arranged in the optical path. An image formed on the liquid crystal display plate 404 is projected onto a screen (not depicted) via the lens unit 405.

Note that a combination of lamp unit 200 and the lamp lighting apparatus 300 of the present invention is also applicable to other types of projection-type image display apparatuses, such as DLP™ projectors using DMD (Digital Micromirror Device) technology and other liquid crystal projectors using reflective-type liquid crystal apparatuses.

Embodiment 2

In embodiment 1, the temperature of the electrode tip is measured with use of an infrared camera. In embodiment 2, however, an excessive rise in the temperature of the electrode tips is prevented using a simpler structure, by introducing timer control, etc.

Note that a description of the lamp targeted for lighting in the present embodiment has been omitted due to being similar to the lamp described using FIG. 1 in embodiment 1.

1. Lighting Apparatus

FIG. 6 shows the structure of an electronic ballast 310 pertaining to embodiment 2. In FIG. 6, the same reference characters have been used for functional blocks that are the same as in FIG. 3.

As shown in FIG. 6, the electronic ballast 310 includes the DC/DC converter 302, the DC/AC inverter 303, the tube current detection unit 304, the tube voltage detection unit 305, the control circuit 306, and the high voltage pulse generation unit 308.

The DC power circuit 301 includes, for example, a rectifier circuit. The DC power circuit 301 generates a DC voltage from household 100 [V] AC and supplies the DC voltage to the electronic ballast 310.

The DC/DC converter 302 supplies DC having a predetermined voltage to the DC/AC inverter 303.

The DC/AC inverter 303 generates a square wave AC having a predetermined frequency in accordance with a control signal received from the control circuit 306.

The high voltage pulse generation unit 308 includes, for example, a transformer. The high voltage pulse generation unit 308 generates and applies a high voltage to the lamp 100.

The control circuit 306 performs overall control of the DC/DC converter 302, the DC/AC inverter 303, etc. The control circuit 306 includes the power calculation circuit 306*a*, the PWM control circuit 306*b*, and the timer 306*c*.

The power calculation unit 306*a* calculates the lamp power based on a lamp current and lamp voltage detected by the tube current detection unit 304 and tube voltage detection unit 305 respectively.

The PWM control circuit 306*b* controls current etc. by performing pulse-width modulation.

The timer 306*c* measures time from lighting commencement.

2. Lighting Method

The following describes a lighting method of the present embodiment.

FIG. 7 is a graph showing a relationship between lamp power and lighting time in an initial lighting stage of the lamp 100. In FIG. 7, the dashed line shows a locus in a conventional lighting method, and the solid line shows a locus in the lighting method of the present embodiment.

The conventional method involves performing constant current control at 4 [A] after lighting commencement, and then changing to constant power control when the power reaches 250 [W] (the rated power).

The lighting method of the present embodiment involves performing constant current control at 4 [A] during warm-up after lighting commencement, then performing constant power control at 200 [W] when the power reaches 200 [W] (which is lower than the rated power of 250 [W]), and thereafter changing to performing constant power control at the rated power of 250 [W].

FIG. 8 is a graph showing a relationship between lighting time and 850 [nm] wavelength intensity in a proximity of the tips of the electrodes 102 and 103. Similarly to FIG. 7, the dashed line in FIG. 8 shows a locus in the conventional lighting method, and the solid line in FIG. 8 shows a locus in the lighting method of the present embodiment.

In the present example, the wavelength intensity of 850 [nm] light beams emitted from the tips of the electrodes 102 and 103 is used as a parameter indicating the tip temperature.

In the present embodiment, the measuring method specifically involves the following. The lamp 100 is mounted in the previously-described image display apparatus without the reflecting mirror 203, in a manner such that the optical axis of the projection lens of the image display apparatus is orthogonal to the tube axis of the lamp 100. The lamp 100 is lit, the electrode is projected onto a screen, an infrared spectrograph is arranged at a place on the projected image that corresponds to 0.1 mm from the tip of the actual electrode, and the 850 [nm] wavelength intensity at said place is detected. Note that the method for measuring the wavelength intensity of the electrode tip portions is not limited to the above method. Another known method may be used.

Note that details of the relationship between wavelength intensity and temperature are found in, for example, "Infrared Thermometer Seminar Handbook" (IRCON, INC., http://www.kawaso.co.jp/eng/seminahb.pdf).

Also, FIG. 9 is a graph showing transitions in lamp voltage over a cumulative lighting time in which the lamp is repeatedly turned on for two hours and turned off for 15 minutes. Locus a is the result of using the conventional lighting method, and locus b and locus c (two samples) are the results of using the lighting method of the present embodiment.

According to the transitions in the wavelength intensity shown in FIG. 8, from approximately 50 seconds until 80 seconds in the conventional lighting method, the tip temperature of the electrodes 102 and 103 rises excessively (overshoots) compared to the temperature during stable lighting. In particular, as shown by the oval A in FIG. 8, the rise in temperature peaks in the vicinity of 55 seconds.

Also, according to the locus a in FIG. 9, the lamp voltage tends to rise as the lighting time elapses in the conventional lighting method. In particular, as shown by the circled portions in FIG. 9, the lamp voltage rises sharply in each interval corresponding to lighting warm-up. A rise in lamp voltage means that the inter-electrode distance has increased, which causes a deviation from a point light source, thereby bringing about a reduction in illuminance.

In contrast, in the lighting method of the present embodiment, the tip temperature of the electrodes 102 and 103 during lighting warm-up hardly exceed the temperature during stable lighting, as shown by the solid line of FIG. 8. Also, locus b and locus c of FIG. 9 show that a rise in lamp voltage is suppressed regardless of the how much cumulative lighting time has elapsed. These facts indicate that the inter-electrode distance is stable.

The following conclusions can be drawn from the differences in transitions in lamp voltage and the tip temperature of the electrodes 102 and 103 when using the lighting method of the present embodiment and the conventional lighting method.

Firstly, an excessive rise in the tip temperature of the electrodes 102 and 103 can be said to have been suppressed since the load when the power is 200 [W] (a current of 4 [A]) at an elapsed time of 45 seconds (see oval B in FIG. 8) is less than the load at the conventional peak time (see oval A in FIG. 8).

Also, although the lamp voltage is elevated from 45 seconds to 120 seconds, the tip temperature of the electrodes 102 and 103 falls as the current falls from 4 [A] to 2.5 [A].

When the power is changed (from 200 [W] to 250 [W]) after 120 seconds has elapsed, the current value rises from 2.5 [A] to 3.13 [A]. However, the reason that the tip portion temperature t [degrees C.] does not overshoot is thought to be that the kinetic energy of electrons bombarding the electrode tip portions after 120 seconds in the present embodiment is less than the kinetic energy of electrons bombarding the electrode tip portions at around 55 seconds in the conventional lighting method in which overshooting occurs (i.e., the temperature of the electrons is lower in the former case).

Specifically, as shown in FIG. 10A, the pressure of the gas in the arc tube (the light emitting space 108) has not sufficiently risen between lighting commencement and when 60 seconds has elapsed, and therefore electrons (shown as "e") emitted from the cathode 103 directly bombard the anode 102.

However, as shown in FIG. 10B, since the argon gas pressure rises after 120 seconds has elapsed since lighting commencement, the probability that the electrons will collide with the argon gas particles (shown as "g") increases. The collisions are thought to transfer some of the kinetic energy of the electrons to the argon gas particles, and therefore the electrons have a lower kinetic energy when they arrive at the anode 102.

The following describes concrete examples of control in the lighting method of the present embodiment.

Control Example 1

FIG. 11 is a flowchart showing control example 1 of the present lighting method. The control shown in FIG. 11 is performed by the control circuit 306 (see FIG. 6) of the previously-described electronic ballast 310.

First, the high voltage pulse generation unit 308 generates and applies a high voltage between the electrodes 102 and 103 in the lamp 100 to cause dielectric breakdown and start a discharge (step S11), and the timer 306*c* begins measuring time (step S12).

During the warm-up interval after dielectric breakdown occurred between the electrodes 102 and 103, the control circuit 306 performs constant power control at 4 [A] until the lamp voltage becomes greater than or equal to a predetermined voltage value Va [V] (steps S13, S14). In the present example, the predetermined voltage value Va [V] is 50 [V].

When the lamp voltage reaches 50 [V] (step S14: YES), the control circuit 306 performs constant power control at a power value Pa [W] (200 [W]) that is lower than the rated power Ps [W], until the time measured in step S12 reaches 120 seconds (steps S15, S16).

After 120 seconds has elapsed (step S16: YES), the control circuit 206 increases the current to the rated current and performs constant power control at the rated power of 250 [W] until lighting has ended (steps S17, S18, S19).

As described above, according to the lighting method for the high pressure lamp of the present embodiment, instead of immediately increasing the lamp power to the rated power Ps [W] (250 [W]) during the lighting warm-up interval, constant power control is performed at the power Pa [W] (e.g., 200 [W]) that is lower than the rated power, and then the power is increased to the rated power once the tip temperature of the electrodes 102 and 103 has stabilized. This method prevents the temperature of the electrodes from overshooting during the lighting warm-up interval as in conventional technology, thereby eliminating a significant increase in the electrode temperature during stable lighting.

Also, a luminous flux and illuminance that are substantially equivalent to stable lighting can be achieved if the lower power Pa [W] is, for example, 200 [W] (80% of the output at the rated power). Therefore, even though the time until reaching stable lighting at the rated power of 250 [W] is longer than in conventional technology, the user will not notice a lengthened lighting warm-up interval since an adequate degree of illuminance is achieved while performing constant power control at 200 [W].

FIG. 12 shows a relationship between lamp current I1*a* [A] and lamp voltage V1*a* [V] in the lighting control of FIG. 11.

After dielectric breakdown occurs in the lamp, constant current control is first performed at 4 [A] (C1), and then constant power control is performed at 200 [W] when the lamp voltage reaches 50 [V] (C2). When 120 seconds has elapsed since lighting commencement, constant power control is performed at 250 [W] (C3), and continues to be performed at 250 [W] thereafter (C4).

Also, FIGS. 13A and 13B respectively show a relationship between time [s] after lighting commencement and lamp power [W] and a relationship between time [s] after lighting commencement and lamp current [A] under the same lighting control. Note that FIGS. 13A and 13B show examples of using an 80 [V] lamp (a lamp whose voltage does not exceed 80 [V] in the lamp properties) as the high pressure discharge lamp 100.

As shown in FIG. 13A, during the lighting warm-up interval after lighting commencement (i.e., during the initial lighting interval), the lamp power gradually rises due to the constant current control at 4 [A], constant power control is performed at 200 [W] when the lamp power reaches 200 [W], and then constant power control is performed at 250 [W] when 120 seconds has elapsed since lighting commencement. Although FIG. 13B shows a relationship between time and lamp current under the same control, an 80 [V] lamp is used, and therefore the lamp current is constant at 3.125 [A] during constant power control at 250 [W] after 120 seconds has elapsed.

Although the constant power control is changed from 200 [W] to 250 [W] at once in the examples shown in FIGS. 13A and 13B, it is preferable to gradually change from 200 [W] control to 250 [W] control in order to even more effectively suppress over-shooting of the tip temperature.

In view of this, the power may be smoothly increased from 200 [W] to 250 [W] by, for example, setting a time constant in the electronic ballast 310. FIGS. 14A and 14B show examples in this case.

As shown in FIGS. 14A and 14B, gradual-increase intervals 131 and 132 occur while the constant power control changes from 200 [W] to 250 [W], thereby suppressing a sudden change in the lamp power.

Note that embodiment 1 described the high pressure discharge lamp 100 using the example of a lamp designed so that the lamp voltage does not exceed 80 [V] in the lamp properties, that is to say, so that the maximum voltage value is 80 [V] (a proper value). However, strictly setting the maximum lamp voltage value to 80 [V] places an excessive burden on management in the manufacturing process and reduces productivity. Therefore, in consideration of a slight amount of variation in manufacturing, 80 [V] is set as the central design value for the lamp voltage, and a tolerable range is from 62.5 [V] (lower limit) to 95 [V] (upper limit) (hereinafter, this range of lamp voltages designed as the lamp properties is called the "specified voltage range"), and a central value and tolerable range are also set for the inter-electrode distance De. In this case, the central value for the inter-electrode distance De is 1.0 [mm], and the tolerable range is a variation of +−0.2 [mm].

According to the maximum lamp voltage value that is actually used, the rated current value (3.125 [A]) in the constant power control at 250 [W] in FIGS. 13B and 14B varies somewhat, but almost no difference in the effects is seen. Also, even if the maximum lamp voltage is 95 [V], which is the upper limit of the specified voltage range, constant power control may be performed in step S18 of FIG. 11 when the lamp power reaches 250 [W], before increasing the current to the pre-set rated current (3.125 [A]). This method prevents the lamp power from exceeding 250 [W].

Control Example 2

In control example 1, the following three stages are performed to control the power supplied to the high pressure discharge lamp 100 in the initial lighting interval: (1) constant current control at a lamp current of 4 [A], (2) constant power control at 200 [W] when the lamp power reaches 50 [V] (lower power lighting interval), and (3) constant power control at 250 [W] after a predetermined time period has elapsed since lighting commencement. However, control example 2 is characterized by the following. A constant current value Ib [A] is supplied as the lamp current so that Ib [A]*Vb [V] is less than the rated power Ps [W], where Vb [V] is the upper lamp voltage limit in the specified voltage range set in the lamp properties. This method realizes the addition of a control interval (lower power lighting interval) at a lower power than the rated power Ps [W] before moving to constant power control at the rated power Ps [W].

FIG. 15 is a flowchart showing the present control example 2. Note that the specified voltage range of the high pressure lamp 100 used in the present control example 2 has also been set to from 62.5 [V] to 95 [V] inclusive, as design values in the lamp properties. Accordingly, the constant current value Ib [A] of the lamp current supplied before performing constant power control at the rated power Ps [W] is set to a value of, for example, 2.5 [A] that is less than Ps [W] (=250 [W])/Vb [V] (=95 [V]).

Also, the high pressure discharge lamp 100 used in the present control example has been designed so that the lamp voltage does not exceed 80 [V] in the lamp properties, that is to say, so that the maximum voltage value Vc [V] that is unique to the lamp is 80 [V] (a proper value).

First, a high voltage is applied to the lamp 100 to cause dielectric breakdown (step S21), and the timer 306*c* begins measuring time (step S22).

Next, constant current control is performed so that the lamp current (Ib [A]) is kept at 2.5 [A] (step S23).

During this interval, the lamp voltage gradually rises to but does not exceed 80 [V]. From this point until the time measured in step S22 reaches 120 seconds, constant power control is performed at substantially 200 [W].

When 120 seconds has elapsed (step S24: YES), the lamp current is increased to the rated current (3.125 [A]), and constant power control is performed at 250 [W] until lighting has ended (steps S25, S26, S27).

FIG. 16A shows a relationship between time [s] after lighting commencement and lamp power [W] under the lighting control of control example 2, and FIG. 16B shows a relationship between time [s] after lighting commencement and lamp current [A].

As shown in FIG. 16A, the lamp power gradually rises due to 2.5 [A] constant current control after lighting commencement, and the lamp voltage reaches 80 [V] when the lamp power becomes 200 [W]. Accordingly, constant power control is performed at substantially 200 [W] without the lamp voltage rising any further. Thereafter, constant power control is performed at 250 [W] when 120 seconds has elapsed since lighting commencement.

FIG. 16B shows a relationship between time [s] after lighting commencement and lamp current. Since the lamp that is used has a maximum voltage value Vc [V] of 80 [V], the lamp current is constant at 3.125 [A] during the constant power control at 250 [W] after 120 seconds has elapsed since lighting commencement.

In the present control example as well, the change from 200 [W] constant power control to 250 [W] constant power control may be performed gradually as shown in FIGS. 17A and 17B.

As shown in FIGS. 17A and 17B, gradual-increase periods 141 and 142 occur while the constant power control changes from 200 [W] to 250 [W], thereby suppressing a sudden change in the lamp power, which even more effectively prevents the tip temperature from overshooting.

Note that in the present control example, when the lamp that is used has a maximum voltage value Vc [V] of 70 [V], the lower power Pa [W] is 175 (=70*2.5) [W]. After 120 seconds has elapsed, changing the current value from 2.5 [A] to 3.6 [A] in accordance with the 250 [W] control curve enables changing to constant power control at the rated power of 250 (=70*3.6) [W].

FIG. 18 is a graph showing a relationship between lamp voltage and lamp current in a case of using a lamp whose maximum voltage value Vc [V] is 95 [V], which is the upper limit of the specified voltage range in the properties of the lamp in the present control example 2. In FIG. 18, the dashed-dotted line indicates the present control example, and the solid line corresponds to a conventional control example.

In FIG. 18, constant current control is first performed at 2.5 [A] (E1), then constant power control is performed at 237.5 [W] when the lamp voltage reaches 95 [V] since the lamp voltage does not rise any further. After 120 seconds has elapsed since lighting commencement, power control is changed to constant power control at 250 [W] (E2, E3), thereby ensuring an interval of lighting at a power value (273.5 [W]) that is lower than the rated power (i.e., a lower power lighting interval).

Supplementary Remarks

1. Configuration of Electrode Tips

In the embodiments, the tip portions 124 and 134 of the electrodes 102 and 103 have a substantially conical configuration. In such a case, an excessive rise in the temperature of the electrodes 102 and 103 is explicit, and therefore applying the lighting method of embodiments 1 or 2 is extremely effective. However, instead of being limited to cases in which the tip portions have a substantially conical configuration, the lighting methods of embodiments 1 and 2 are applicable to electrodes having a substantially hemispherical or substantially spherical configuration. Also, instead of being limited electrodes whose tip portions have been formed by fusing, the lighting methods of embodiments 1 and 2 are also applicable to electrodes formed by machining etc.

2. Setting of Lower Power Value when Changing from Constant Current Control to Constant Power Control at a Power Lower than the Rated Power In the embodiments, power control changes to constant power control when the lamp power reaches 200 [W]. The upper limit of the power lower than the rated power is preferably set to a value just low enough to prevent the electrode temperature from overshooting. Also, if the lower limit is set too low, a sufficient luminous flux cannot be obtained while the electrode temperature is stable. Therefore, the lower limit is preferably set to a value that does not cause a noticeable reduction in luminous flux compared to stable lighting. Specifically, a range of 70% to 90% of the rated power is preferable.

3. Rise from Lower Power to Rated Power

In embodiment 2, power control is changed directly from the lower power of 200 [W] to the rated power of 250 [W]. However, the changing may be performed gradually by, for example, setting a timer value so that power control is changed from 200 [W] to 225 [W] after 120 seconds has elapsed since lighting commencement, and then from 225 [W] to 250 [W] after another 20 seconds has elapsed. This method further enables preventing the tip temperature from overshooting.

4. Lamps to which the Present Invention is Applicable

Although the above embodiments describes examples of using a high pressure mercury lamp having a rated power of 250 [W], the problem of a reduction in illuminance in conventional lighting control exists in not only high pressure mercury lamps but also other high pressure discharge lamps that include mercury, due to the cause of the problem (overshooting of the electrode tip temperature when changing from constant current control during the initial lighting interval to constant power control at the rated power). Also, the lamp is not limited to have a rated power of 250 [W]. Accordingly, the present invention is applicable to all high pressure discharge lamps including mercury.

For example, even in the case of a high pressure discharge lamp having a rated output of 180 [W], the enclosed amount of materials, particularly the halogen, is optimized so that the halogen cycle functions properly with respect to the electrode tip temperature during stable lighting at the rated power, and therefore the halogen cycle would fail to function properly if the electrode tip temperature in the initial lighting interval rises excessively over the temperature during stable lighting, as a result of which the arc length tends to increase.

5. Time from Lighting Commencement to Changing to Rated Power

In embodiment 2, changing to rated power is performed when 120 seconds has elapsed since lighting commencement (hereinafter, the time from lighting commencement to constant power control at the rated power is called the "change-to-rated time").

However, the time period of "120 seconds" is merely one example of the change-to-rated time. As previously described, in the conventional lighting method, over-shooting of the electrode tip temperature occurs because electrons directly bombard the electrode tip portions due to changing to constant power control at the rated power even though the atoms of the gas enclosed in the arc tube have not been sufficiently excited. The excited state of the enclosed gas differs depending on, for example, the current value in the constant current control directly after lighting commencement, and the value of the power in the constant power control at a power lower than the rated power. In the case of a lower rated power, the load of the current during changing to constant power control at the rated power is commensurately lower, thereby suppressing overshooting that effects the inter-electrode distance at a change-to-rated time of around 90 seconds, which is shorter than the previously-described rated change time of 120 seconds.

Accordingly, a specific change-to-rated time can be easily obtained by a person skilled in the art by performing repeated experiments as shown in FIG. 7, comprehensively taking in consideration conditions such as the rated power of the lamp, the current value of the constant current control, and the power value Pa [W] in the power control at a power lower than the rated power.

Here, for example, the integral value of power (cumulative energy) introduced to the lamp until changing to constant current control at the rated power would be an effective parameter.

INDUSTRIAL APPLICABILITY

A lighting apparatus of the present invention is suitable for suppressing a reduction in illuminance in a high pressure discharge lamp, and particularly in a high pressure discharge lamp combined with a reflecting mirror.

The invention claimed is:

1. A lighting method for lighting a high pressure discharge lamp having an arc tube in which mercury is enclosed as a light-emitting material and in which a pair of electrodes are arranged, comprising the steps of:

commencing lighting by applying a predetermined voltage to the pair of electrodes to cause dielectric breakdown to occur therebetween;

performing lighting warm-up by, in an initial lighting interval from lighting commencement to constant power control at a rated power value Ps [W] of the high pressure discharge lamp, controlling a lamp power supplied to the high pressure discharge lamp according to a predetermined condition, wherein the lighting warm-up step includes:

a first sub-step of performing constant current control at a current value Ia [A];

a second sub-step of performing constant power control at the power value Pa [W] when a lamp voltage of the high pressure discharge lamp reaches a value Va [V;] and a third sub-step of changing to constant power control at the rated power value Ps [W] upon elapse of a predetermined time period beginning at lighting commencement, a relational expression Ia [A]*Va [V]=Pa [W] is satisfied, and the second sub-step is performed in the lower-power lighting interval; and performing stable lighting to cause the high pressure discharge lamp to be lit stably by performing constant power control at the rated power value Ps [W], wherein in the lighting warm-up step, the lamp power is controlled according to the predetermined condition that the initial lighting interval includes a lower-power lighting interval in which lighting is sustained at a constant power value Pa [W] that is lower than the rated power value Ps [W].

2. The lighting method of claim 1, wherein the power value Pa [W] in the lower-power lighting interval is in a range of 70% to 90% inclusive of the rated power value Ps [W].

3. A method of projecting an image by an image display apparatus including a high pressure discharge lamp having an arc tube that is lit by the lighting method of claim 1.

4. A lighting method for lighting a pressure discharge lamp having an arc tube in which mercury is enclosed as a light-emitting material and in which a pair of electrodes are arranged, comprising the steps of:

commencing lighting by applying a predetermined voltage to the pair of electrodes to cause dielectric breakdown to occur therebetween;

performing lighting warm-up by, in an initial lighting interval from lighting commencement to constant power control at a rated power value Ps [W] of the high pressure discharge lamp, controlling a lamp power supplied to the high pressure discharge lamp according to a predetermined condition, wherein the lighting warm-up step includes:

a first sub-step of performing constant current control at a current value Ib [A], a lamp voltage range being specified as a design property of the high pressure discharge lamp, and the current value Ib [A] being determined so that a relational expression Ib [A]*Vb [V]<Ps [W] is satisfied, where Vb [V] is a current value that is an upper limit of the specified lamp voltage range; and a second sub-step of changing to constant power control at the rated power value Ps [W] upon elapse of a predetermined time period beginning at lighting commencement, and the lower-power lighting interval is an interval from when the lamp voltage reaches a lamp voltage Vc [V] to before when the second sub-step is performed, the lamp voltage Vc [V] being in the lamp voltage range and being a maximum lamp voltage unique to the high pressure discharge lamp targeted for lighting in the first sub-step; and performing stable lighting to cause the high pressure discharge lamp to be lit stably by performing constant power control at the rated power value Ps [W], wherein in the lighting warm-up step, the lamp power is controlled according to the redetermined condition that the initial lighting interval includes a lower-power lighting interval in which lightning is sustained at a constant power value Pa [W] that is lower than the rated power value Ps [W].

5. A method of projecting an image by an image display apparatus including a high pressure discharge lamp having an arc tube that is lit by the lighting method of claim 4.

6. A lighting apparatus for lighting a high pressure discharge lamp having an arc tube in which mercury is enclosed as a light-emitting material and in which a pair of electrodes are arranged, the lighting apparatus comprising:

a power supply unit operable to supply power to the high pressure discharge lamp; and a control unit operable to (a) commence lighting by causing the power supply unit to apply a predetermined voltage to the pair of electrodes to cause dielectric breakdown to occur therebetween, (b) in an initial lighting interval from lighting commencement to constant power control at a rated power value Ps [W] of the high pressure discharge lamp, control the power supply unit to supply a lamp power to the high pressure discharge lamp according to a predetermined condition, wherein in the initial lighting interval, the control unit performs a first control for causing the power supply unit to output a constant current having a current value Ia [A], a second control for causing the power supply unit to output a constant power having the power value Pa [W] when a lamp voltage of the high pressure discharge lamp reaches a value Va [V], and a third control for changing to constant power control at the rated power value Ps [W] upon elapse of a predetermined time period beginning at lighting commencement, a relational expression Ia [A]*Va [v]=Pa [W] is satisfied, and the second control is performed in the lower-power lighting interval, and (c) cause the high pressure discharge lamp to be lit stably by performing constant power control at the rated power value Ps [W], wherein the control unit controls the power supply unit to supply the lamp power according to the predetermined condition that the initial lighting interval includes a lower-power lighting interval in which lighting is sustained at a constant power value Pa [W] that is lower than the rated power value Ps [W].

7. The lighting apparatus of claim 6, wherein the power value Pa [W] in the lower-power lighting interval is in a range of 70% to 90% inclusive of the rated power value Ps [W].

8. A high pressure discharge lamp apparatus comprising:

a high pressure discharge lamp;

a reflecting mirror that reflects light emitted from the high pressure discharge lamp; and a lighting apparatus according to claim 6 for lighting the high pressure discharge lamp.

9. A projection-type image display apparatus including a high pressure discharge lamp apparatus according to claim 8.

10. A lighting apparatus for lighting a high pressure discharge lamp having an arc tube in which mercury is enclosed as a light-emitting material and in which a pair of electrodes are arranged, the lighting apparatus comprising:

a power supply unit operable to supply power to the high pressure discharge lamp and a control unit operable to (a) commence lighting by causing the power supply unit to apply a predetermined voltage to the pair of electrodes to cause dielectric breakdown to occur therebetween (b) in an initial lighting interval from lighting commencement to constant power control at a rated power value Ps [W] of the high pressure discharge lamp, control the power supply unit to supply a lamp power to the high pressure discharge lamp according to a predetermined condition, wherein in the initial lighting interval, the control unit performs a first control for causing the power supply unit to output a constant current value Ib [A], a lamp voltage range being specified as a design property of the high pressure discharge lamp, and the current value Ib [A] being determined so that a relational expression Ib [A]*Vb [V]<Ps [W] is satisfied, where Vb [V] is a current value that is an upper limit of the specified lamp voltage range; and a second control for changing to constant power control at the rated power value Ps [W] upon elapse of a predetermined time period beginning at lighting commencement, and the lower-power lighting interval is an interval from when the lamp voltage reaches a lamp voltage Vc [V] to before when the second control is performed, the lamp voltage Vc [V] being in the lamp voltage range and being a maximum lamp voltage unique to the high pressure discharge lamp targeted for lighting in the first control, and (c) cause the high pressure discharge lamp to be lit stably by performing constant power control at the rated power value Ps [W], wherein the control unit controls the power supply unit to supply the lamp power according to the predetermined condition that the initial lighting interval includes a lower-power lighting interval in which lighting is sustained at a constant power value Pa [W] that is lower than the rated power value Ps [W].

11. A high pressure discharge lamp apparatus comprising:

a high pressure discharge lamp;

a reflecting mirror that reflects light emitted from the high pressure discharge lamp; and a lighting apparatus according to claim 10 for lighting the high pressure discharge lamp.

12. A projection-type image display apparatus including a high pressure discharge lamp apparatus according to claim 11.

* * * * *

UNITED STATES PATENT AND TRADEMARK OFFICE

CERTIFICATE OF CORRECTION

PATENT NO. : 8,310,174 B2
APPLICATION NO. : 12/667223
DATED : November 13, 2012
INVENTOR(S) : Masaru Ikeda It is certified that error appears in the above-identified patent and that said Letters Patent is hereby corrected as shown below:

On the Title Page:

Under References Cited

Foreign Patent Documents,
The following references should be listed:
--EP 1768468
EP 1740022
EP 14408723
JP 2000-306687
JP 2002-093363--

Signed and Sealed this
Thirteenth Day of August, 2013

Teresa Stanek Rea
*Acting Director of the United States Patent and Trademark Office*